US006243551B1

(12) United States Patent
Berlin

(10) Patent No.: US 6,243,551 B1
(45) Date of Patent: Jun. 5, 2001

(54) ELECTROPHOTOGRAPHIC COPYING METHOD AND APPARATUS

(75) Inventor: Genadi Berlin, Tel Aviv (IL)

(73) Assignee: Elfotek Ltd., Rosh Ha'Ayin (IL)

( * ) Notice: Subject to any disclaimer, the term of this patent is extended or adjusted under 35 U.S.C. 154(b) by 0 days.

(21) Appl. No.: 09/464,429

(22) Filed: Dec. 16, 1999

(30) Foreign Application Priority Data

Jan. 7, 1999 (IL) ..... 127951
Jun. 13, 1999 (IL) ..... 130442

(51) Int. Cl.[7] ..... G03G 15/00

(52) U.S. Cl. ..... 399/145; 399/302; 399/308; 430/31

(58) Field of Search ..... 399/145, 139, 399/137, 302, 308; 430/54, 31

(56) References Cited

U.S. PATENT DOCUMENTS 2,951,443 * 9/1960 Byrne ..... 101/426
3,045,587 * 7/1962 Schwertz ..... 101/1
3,244,083 * 4/1966 Gundlach ..... 95/1.7
3,363,555 * 1/1968 Olden ..... 101/426
3,508,823 * 4/1970 Gundlach et al. ..... 355/3
3,615,128 * 10/1971 Bhagat ..... 355/3
3,659,936 * 5/1972 Klose ..... 355/3
3,697,160 * 10/1972 Clark ..... 355/3
3,752,573 * 8/1973 Miller ..... 355/11
3,843,381 * 10/1974 Matsumoto et al. ..... 117/17.5
3,879,197 * 4/1975 Bartlett ..... 96/1.4
3,937,571 * 2/1976 Krulik et al. ..... 355/3 R
3,961,951 * 6/1976 Mayer et al. ..... 96/1.4
3,989,364 * 11/1976 Kawakami et al. ..... 355/3 R
4,021,106 * 5/1977 Gaynor ..... 355/3 R
4,021,109 * 5/1977 Tanaka et al. ..... 355/8
4,110,031 * 8/1978 Ebi et al. ..... 355/14
4,142,792 * 3/1979 Satomi et al. ..... 355/14
4,171,157 * 10/1979 Suzuki ..... 355/3 TR
4,172,722 * 10/1979 Hirakura et al. ..... 96/1.4
4,204,730 * 5/1980 Miyashita et al. ..... 355/14 R
4,218,129 * 8/1980 Ishimoto et al. ..... 355/14 SH
4,220,699 * 9/1980 Ishida et al. ..... 430/126
4,241,160 * 12/1980 Kuehnle ..... 430/124
4,244,646 * 1/1981 Bayer et al. ..... 355/3 R (List continued on next page.)

OTHER PUBLICATIONS

"*A New Digital Color Xeroprinting Technology*", Journal of Imaging Science and Technology, vol. 36, No. 1 (1/2), Jan./Feb. 1992.

"*A Review of Electrographic Printing*", D.E. Bogner, Journal of Imaging Science, vol. 35, No. 6 (11/12), Nov./Dec. 1991.

"*Electrophotography*", R. M. Shaffert, Focal Press, London, 1975.

"Applications of Multi–beam Acousto–optical Modulators in Laser–electrophotographic Printing and Drawing Machines", S. B. Tōkès, Computer and Automation Institute, Hungarian Academy of Sciences, Budapest, Hungary Jul. 2000.

*Primary Examiner*—Richard Moses
(74) *Attorney, Agent, or Firm*—Fitch, Even, Tabin & Flannery

(57) ABSTRACT

Method and apparatus are presented for electrophotographic copying of original information. One cycle of the copying method consists of the following. An electrostatic image of the copying information is recorded onto a recording photoreceptor, and the recording photoreceptor is used to form a latent electrostatic image on an intermediate information carrier. The latent electrostatic image is developed on the intermediate information carrier, and the developed image is transferred onto a final information carrier. The intermediate information carrier is a photoreceptor of a kind capable of, when being charged, storing the charge during a period of time required for producing a desired number of copies.

22 Claims, 14 Drawing Sheets

U.S. PATENT DOCUMENTS

| | | | | |
|---|---|---|---|---|
| 4,268,157 | * | 5/1981 | Ebi et al. | 355/3 TR |
| 4,286,865 | | 9/1981 | Satomi et al. | 355/14 |
| 4,297,422 | | 10/1981 | Sato | 430/54 |
| 4,297,423 | | 10/1981 | Nishikawa | 430/54 |
| 4,325,625 | * | 4/1982 | Nakatsubo et al. | 355/35 SC |
| 4,327,167 | | 4/1982 | Tanabe | 430/31 |
| 4,329,043 | * | 5/1982 | Kuehnle | 355/14 R |
| 4,334,772 | * | 6/1982 | Suzuki | 355/3 DD |
| 4,354,756 | * | 10/1982 | Arai et al. | 355/3 R |
| 4,371,539 | | 2/1983 | Stein | 424/272 |
| 4,371,599 | | 2/1983 | Lind et al. | 430/49 |
| 4,381,147 | * | 4/1983 | Kasamura et al. | 355/14 R |
| 4,391,502 | * | 7/1983 | Nishikawa | 355/3 DD |
| 4,407,918 | | 10/1983 | Sato | 430/54 |
| 4,442,191 | | 4/1984 | Nishikawa | 430/55 |
| 4,443,093 | * | 4/1984 | Yoshino et al. | 355/3 CH |
| 4,531,827 | * | 7/1985 | Tarumi et al. | 355/14 R |
| 4,559,509 | * | 12/1985 | Mayer | 355/3 TR |
| 4,643,559 | * | 2/1987 | Tonegawa | 355/3 R |
| 4,688,927 | * | 8/1987 | Oda et al. | 355/3 TR |
| 4,898,797 | | 2/1990 | Gruenbaum et al. | 430/51 |
| 5,053,304 | | 10/1991 | Mey et al. | 430/59 |
| 5,130,214 | * | 7/1992 | Yokoyama | 430/31 |
| 5,470,644 | | 11/1995 | Durant | 428/209 |
| 5,494,764 | | 2/1996 | Hyodo | 430/31 |
| 5,576,135 | | 11/1996 | Nishikawa | 430/126 |
| 5,995,795 | | 11/1999 | Berlin | 399/313 |

* cited by examiner

ELECTROPHOTOGRAPHIC COPYING METHOD AND APPARATUS

FIELD OF THE INVENTION

This invention is generally in the field of electrophotography, and relates to a method and apparatus for electrophotographic copying enabling multiple-copy production from a single exposure procedure.

BACKGROUND OF THE INVENTION

Known electrophotographic processes, which are used in all modern electrophotographic copying devices, are typically cyclical processes, each cycle carrying out all sequential stages of the entire copy production process. In other words, to produce each copy from an original document, the entire cycle of the electrophotographic process is repeated. Generally, such a cycle includes the following stages:

(1) charging the photosensitive surface of an intermediate information carrier (photoreceptor);

(2) exposure of the charged surface, i.e., recording an image of the original document onto the charged surface of the photoreceptor, thereby forming a latent electrostatic image on this surface;

(3) developing the exposed surface of the photoreceptor;

(4) transfer and fixation of the obtained image on a final carrier (a copy), e.g. a paper; and also the following step (5) neutralizing the residual charges and mechanically cleaning the photoreceptor surface to prepare it for the next cycle.

A copying apparatus based on the known electrophotographic processes has limited throughput. This is due to the inertness of an image scanning system applied for exposing the original document, and the so-called "fatigue" of a photosemiconductor layer under the cyclic stresses thereof in a high-speed charge/discharge mode. Additionally, mechanical wear of the photoreceptor occurs caused by the permanent operation of the cleaner.

In a classical electrophotographic process, storage of the latent electrostatic image for multiple-copy production utilizing single exposure is very difficult, due to the existence of so-called "dark potential decay" on the surface of the photoreceptor. The "dark potential decay" is a phenomenon consisting of time discharge of the photosemiconductor layer in darkness caused by the inherent dark conductivity of the photosemiconductor layer. This dark potential decay is characterized by the exponential nature of the discharge process dynamics, namely it is especially pronounced during the first few seconds after the charging of the photosemiconductor layer. For example, in the case of amorphous Se photosemiconductor layer, the surface potential decreases in darkness from the initial value of 700V to the value of 600V during the first 10 seconds. The more sensitivity of the photosemiconductor layers (e.g., SeTe or $As_2Se_3$), the more the dark potential drop, thus making the application of such photosemiconductors impossible in a classical electrophotographic process for production of a plurality of copies from a single exposure.

In addition to the fact that the dark discharge inside a photosemiconductor layer (i.e., passive discharge) reduces the potential level of a latent electrostatic image, the surface potential value is also affected by external factors, such as the conditions of the development and image transfer processes. The influence of external factors is essentially pronounced in a classical electrophotographic process, wherein surface charges are held solely by the compensating charges of the opposite polarity induced in a conductive substance, which charges have the tendency to flow. This is the reason that the external effect causes an even more intensive (active) discharge of the surface of the photoreceptor, and, consequently, reduction of the potential contrast, which negatively affects the quality of obtained copies.

Attempts have been made to produce a plurality of copies using the classical electrophotographic process. U.S. Pat. No. 4,286,865 discloses a copying apparatus in which a special system for controlling the copying process is used to perform the process in batches of ten copies from one image exposure. When more than 10 copies of the same original are required, the exposure is repeated after each ten copies.

The ability of this process is limited, because both the exposure speed and the process speed (i.e., speed of image reproduction) equal to the exposure speed, and, consequently, the throughput of the apparatus, directly depend on the sensitivity of a photosemiconductor layer, which cannot be sufficiently high in this case. Indeed, the increase in the photosemiconductor layer sensitivity causes acceleration of the dark potential decay, and makes it practically incapable of providing stable conditions for the potential relief of the latent electrostatic image at the level of its initial recording.

Techniques of electrophotographic copying are disclosed, for example, in U.S. Pat. Nos. 4,297,422, 4,297,423 and 4,442,191. According to these techniques, the charge storage on the surface of a photoreceptor is typically provided after the image transfer.

More specifically, in the electrophotographic process disclosed in U.S. Pat. No. '422, the image development stage is followed by initial frame illumination on the photoreceptor, and then, with the concurrent electrization during the image transfer, secondary illumination is performed through a material onto which the developed image is transferred. As specifically indicated in this patent, the charges are to be preserved within shadow sections of the photoreceptor, i.e., within the regions where the developer was present before the image transfer. It is assumed here that image sections are transparent for charge passage therethrough, but are opaque for light passage. This approach does not take into account the dark potential decay within the image sections. It is evident that such a technique is not capable of providing a stable and equal charge value for the production of a next copy.

U.S. Pat. No. '423 describes two examples of the charge storage technique on the surface of a multi-layer organic photoreceptor. According to one example, the charges of a latent electrostatic image on the photoreceptor are neutralized by the charges of the opposite polarity, by means of a preliminary chargeable dielectric layer-neutralizer, and contact recharge of the photoreceptor within the blanked regions of the image is simultaneously carried out. In other words, a negative latent electrostatic image is created, and, thereafter, reverse development and image transfer are performed. According to the other example, the development stage is followed by uniform recharge of the developed surface of the photoreceptor within the entire frame with the corona of the opposite polarity. Thereafter, the frame illumination with the charge neutralization within the blanked regions, and the cleaning of the photoreceptor surface from the developer are performed. Both of the described methods cannot be used for a high-quality high-speed copying process. Moreover, a low lifetime of the organic photoreceptor does not allow its operation in a high-speed copying mode.

Another technique, aimed at storing charges of a latent electrostatic image, utilizes a "locking" dielectric layer accommodated inside a multi-layer photoreceptor structure. For example, according to the disclosure in U.S. Pat. No. 4,407,918, such a dielectric layer is interposed between two photosemiconductor layers of different spectral sensitivity. The main drawback of this approach is that it requires a complicated multiple-operation process associated with the use of a special means of ultraviolet illumination. Moreover, a very thin (2 $\mu$m) surface photosemiconductor layer makes the photoreceptor not sufficiently strong, and consequently, unsuitable for operation under the conditions of the process of multiple-copies production.

U.S. Pat. No. 4,898,797 discloses the use of a multi-layer photoreceptor, in which a dielectric layer is interposed between a conductive substrate and a photosemiconductor layer. In this case, a latent electrostatic image is formed not on the photoreceptor surface, but rather at the inside of the photoreceptor structure, on the boundary dielectric-photosemiconductor. This does not provide a high-quality image reproduction, owing to the fact that the development proceeds through an insulating layer of the photosemiconductor. Moreover, the surface of the photoreceptor layer does not posses sufficient mechanical strength for the multiple-copies production process.

Another technique of the kind specified is disclosed in US Pat. No. 5,053,304. Here, however, a technologically complicated multi-layer photoreceptor is used, which also suffers from the above-described disadvantages.

A detailed analysis of existing techniques aimed at enabling the multiple-copies production is disclosed in the article "*A Review of Electrographic Printing*", D. E. Bugner, Journal of Imaging Science, Volume 35, Number 6, November/December 1991.

The existence of various attempts, directed towards finding the ways of applying the electrophotographic means for operating in the multiple-copies production mode, are associated with the following. The electrophotographic method of multiple-copy production, based on the use of an intermediate information carrier as an electrostatic matrix, is characterized by such advantages (as compared to the other known methods), as operative multiple-copy production and multiple usage of the matrix. The indispensable conditions of the multiple-copy production process include the storage of a charged image on the electrostatic matrix during the entire process of copying, and also physical and mechanical wear-stableness of the matrix.

One of the approaches of applying a wear-stable intermediate information carrier consists of the use of the known TESI-process in its various embodiments, described, for example, in "Electrophotography", R. M. Schaffert, Focal Press., London, 1975. The main concept of the TESI-process consists of the transfer of surface charges of a latent electrostatic image from a photosemiconductor surface to a dielectric one, which is then used as an intermediate information carrier. The most essential drawbacks of this approach include the complexity of its practical application, owing to the fact that conditions of sequential realization of separate stages of the electrostatic image transfer are not the same, which makes it impossible to provide continuity of the copying process in an automatic mode. Additionally, due to the redistribution of charges between the photosemiconductor and dielectric layers (in accordance with their thicknesses, dielectric constant and other characteristics, as well as the conditions of their interaction), the complete and high-quality transfer of the latent electrostatic image cannot be provided. This negatively affects the quality of the so obtained copies, especially during the reproduction of half-tones, because of distortion of the gradation of images of different densities.

The aspiration to create an electrostatic matrix stable for multiple-copy production led to the development of the known NHEP Xeroprinting Technology, disclosed, for example, in the article "*A New Digital Color Xeroprinting Technology*", Journal of Imaging Science and Technology, vol. 36, No 1, January/February 1992. This technology is based on the use of an electrostatic matrix with a specially developed photo-thermo-sensitive layer capable of providing a relatively high stableness for multiple-copies production, as compared to the earlier techniques. However, whilst realizing one of the advantages of the electrophotographic copying method, namely, the multiple use of the electrostatic matrix, NHEP Xeroprinting Technology fails to provide such an advantageous feature of the electrophotography as the operativeness of multiple-copy production, thereby approaching the usual mode of the offset printing. This is due to the fact that the latent electrostatic image formation on the matrix (an intermediate information carrier) requires the following operational stages:

- a preliminary stage (master-making steps) stipulating thermal treatment of the layer to give photosemiconductive properties thereto, which is performed prior to the copying process; and
- a recovery stage performed after the completeness of the copying process for returning the layer into its initial state.

Thermal treatment, used for imparting the sensitivity of the layer and recovering the layer, in addition to special means and conditions, needs time for heating and cooling the layer, and is therefore an inertial process. Matrices for multiple use are actually manufactured separately, under special conditions, which does not enable a continuous copying process to be provided. The situation even worsens when manufacturing four-color matrices, which are usually required for the copying in colors.

In view of the above, it is evident that NHEP Xeroprinting Technology, although being advantageous in some aspects as compared to all other conventional techniques, is not applicable for operative copying. For the above reasons, the known developed techniques aimed at providing the ability for multiple-copies production are not applicable in any one of the existing copying-multiplying systems.

SUMMARY OF THE INVENTION

There is accordingly a need in the art to facilitate the electrophotographic copying technique by providing a novel method and apparatus for electrophotographic copying enabling to develop a highly productive process with high-quality images.

The main idea of the present invention is based on the use of all the stages of the classical electrophotographic process, as listed above, but wherein a latent electrostatic image is formed on an applicable photoreceptor by means of a recording photoreceptor. The applicable photoreceptor has its photosensitive layer coated by a dielectric layer, and functions as an intermediate information carrier, i.e., a so-called "electrostatic memory". To this end, initially, electrostatic recording of the image to be copied is made on the photosensitive surface of the recording photoreceptor. Then, this surface is brought into contact (engagement) with a previously charged dielectric surface of the applicable photoreceptor carrying uniform charge of the opposite polarity. Thereafter, the surfaces of the photoreceptors are disengaged, and the photosensitive layer of the applicable photoreceptor is illuminated, the electrically conductive substrates of both photoreceptors being grounded.

There is thus provided according to one aspect of the present invention, a method of electrophotographic copying of original information utilizing the recording of an electrostatic image of the original information to be copied onto a recording photoreceptor, wherein said electrostatic image is in the form of a pattern that has spaced-apart charged regions of a certain polarity that correspond to image elements and are spaced by blanked uncharged regions, the method including at least one cycle comprising the steps of:

(a) forming a latent electrostatic image of the copying information on an intermediate information carrier in the form of a photoreceptor by means of said recording photoreceptor, wherein the intermediate information carrier is such that it, whilst being charged, stores the charge during a period of time required for producing a desired number of copies of the original information;

(b) developing said latent electrostatic image on the intermediate information carrier;

(c) transforming the developed image from the intermediate information carrier onto a final information carrier; and (d) fixing the transformed image on the final information carrier.

The intermediate information carrier comprises an electrically conductive substrate carrying a photosemiconductor layer with a dielectric coating. The dielectric coating is made of a high- resistance material possessing desired mechanical properties.

The dielectric coating may be transparent to visible light. Alternatively, the dielectric coating may be opaque, in which case the substrate is transparent to visible light and is metallized by a semitransparent layer located thereon, underneath the photosemiconductor layer.

The formation of the latent electrostatic image comprises:

uniformly charging the surface of the intermediate information carrier with charges of the opposite polarity with respect to the charges of the image elements formed on the recording photoreceptor, wherein said charging is carried out with simultaneous illumination of the surface of the intermediate information carrier;

engaging the surfaces of the recording photoreceptor and the intermediate information carrier, and subsequently disengaging these surfaces; and illuminating the photosemiconductor layer of the disengaged intermediate information carrier.

The latent electrostatic image is formed as a potential relief of the surface of the intermediate information carrier. To enable multiple-copy production, this potential relief should preferably be maintained at a given level during the entire process of copying. This can be implemented by recharging the intermediate information carrier, by means of regularly or episodically adding a dosage of charge additionally precipitating onto the dielectric surface, and, optionally, by the sequential episodical illumination of the photosemiconductor layer. The recharging process depends on the nature of carrier discharge, namely passive or active discharge. The recharging procedures may be episodically repeated a required number of times.

Thus, according to another aspect of the present invention, there is provided a method of electrophotographic copying of original information, the method comprising the steps of:

forming a latent electrostatic image on the surface of an intermediate information carrier, said latent electrostatic image being in the form of a potential relief of said surface, wherein said intermediate information carrier comprises a photosemiconductor layer with a dielectric coating, and is such that it, whilst being charged, stores the charge during a period of time required for producing a desired number of copies;

maintaining said potential relief at a given level during the entire process of copying;

developing said latent electrostatic image on the intermediate information carrier;

transforming the developed image from the intermediate information carrier onto a final information carrier; and fixing the transformed image on the final information carrier.

According to yet another aspect of the present invention, there is provided an electrophotographic apparatus for producing a desired number of copies of original information, the apparatus comprising:

(i) a cylindrically shaped recording photoreceptor mounted so as to be radially displaceable between its operative and operative positions;

(ii) a recording system for electrostatic recording of an electrostatic image of said original information onto the recording photoreceptor;

(iii) a cylindrically shaped rotatable intermediate information carrier in the form of a photoreceptor, which is such that it, whilst being charged, stores the charge during a period of time required for producing said desired number of copies;

(iv) an imaging system for forming a latent electrostatic image of the copying information on the intermediate information carrier by means of the recording photoreceptor;

(v) a developer tool for developing the latent electrostatic image on the intermediate information carrier;

(vi) a transfer means for transferring the developed image onto a final information carrier; and (vii) a fixating means for fixating the transferred image on the final information carrier.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1A:
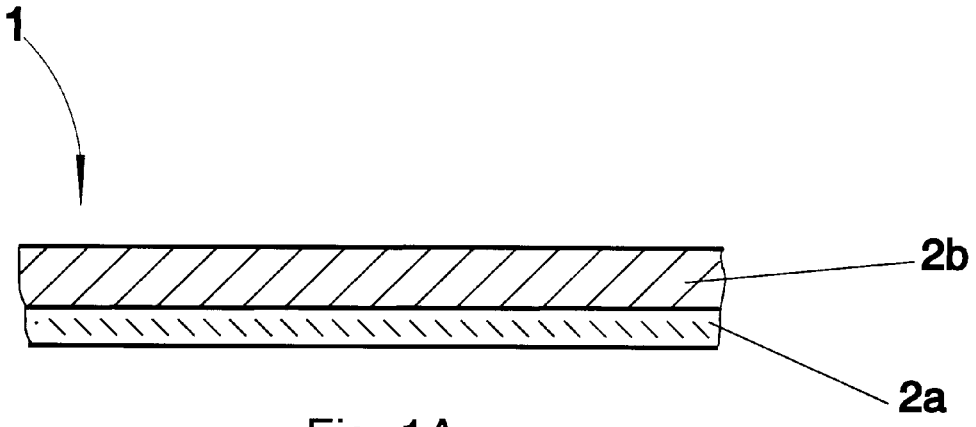
FIG. 1A schematically illustrates a structure of an image recording photoreceptor suitable to be used in an electrophotographic process according to the invention.

Referring to FIG. 1A, there is illustrated a structure, generally designated 1, of an image recording photoreceptor (constituting a recording medium) composed of a conductive substrate 2*a* and a photosemiconductive layer 2*b* on the substrate 2*a*.

Figure 1B:
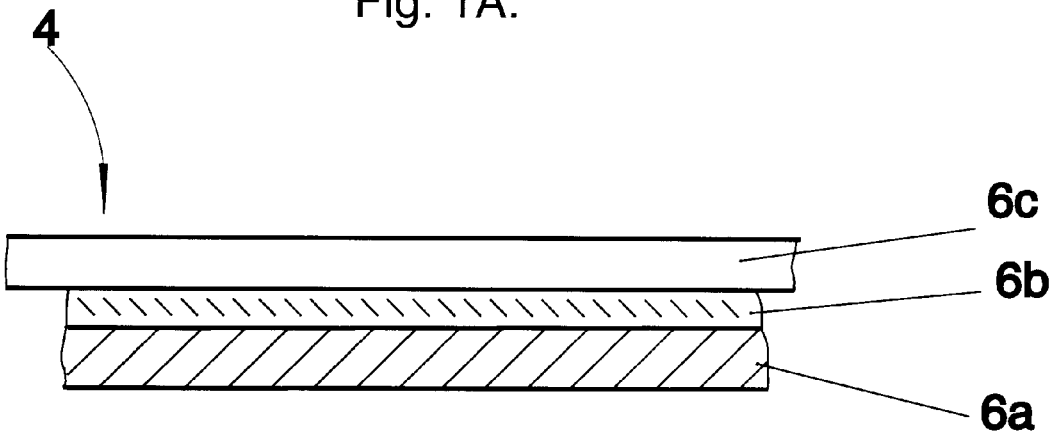
FIGS. 1B and 1C schematically illustrate two different structures of an applicable photoreceptor, respectively, utilizing a transparent dielectric coating and an opaque dielectric coating, which are suitable for the electrophotographic process according to the invention.

FIG. 1B illustrates a structure 4 of an applicable photoreceptor (constituting an intermediate information carrier) composed of a conductive substrate 6*a*, a photosemiconductive layer 6*b* and a laminating layer 6*c*. This laminating layer 6*c* is a dielectric film possessing high mechanical strength and high-resistance characteristics, such as to provide the wear-stableness of the applicable photoreceptor. In the present example, the dielectric film 6*c* is transparent for visible light, for example, a 20 $\mu$m polyethylene-terphtalate film (PET) manufactured by a known extrusion method. The layer 6*c* protects the photosemiconductive layer 6*b* from mechanical and climatic effects, and also maintains the efficiency of the photosemiconductive layer 6*b* in the case of its electric break-down. Moreover, the provision of the laminating layer 6*c* simplifies the maintenance conditions of the photosemiconductor layer 6*b*.

Figure 1C:
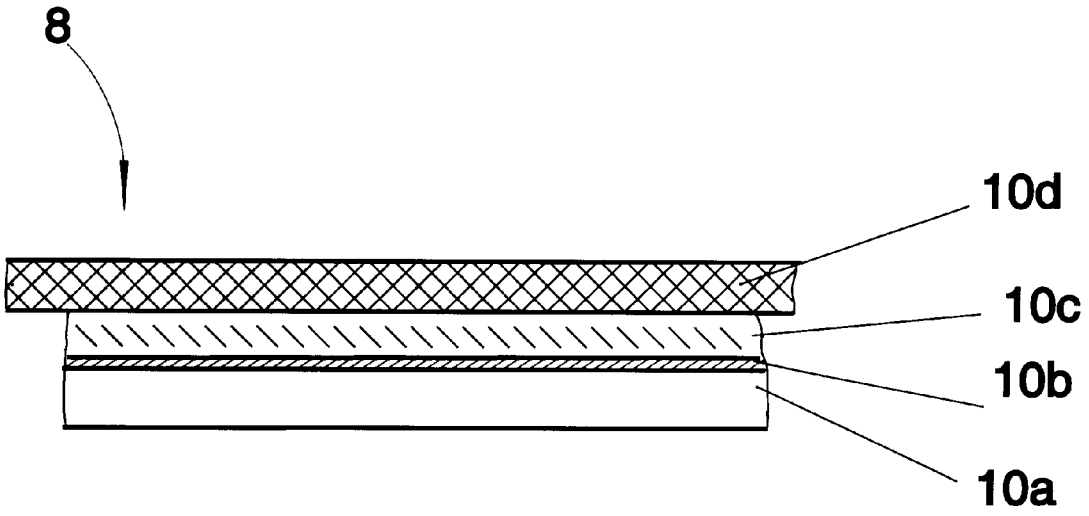

The dielectric film 6*c* may also be in the form of a solid opaque coating. FIG. 1C illustrates an applicable photoreceptor structure 8, utilizing a dielectric solid opaque coating. The photoreceptor 8 includes a base 10*a*, which is transparent to visible light and is metallized by a semitransparent layer 10*b*, a photosemiconductor layer 10*c* and a high-resistance opaque dielectric layer 10*d* having high mechanical-strength properties.

Figure 2A:
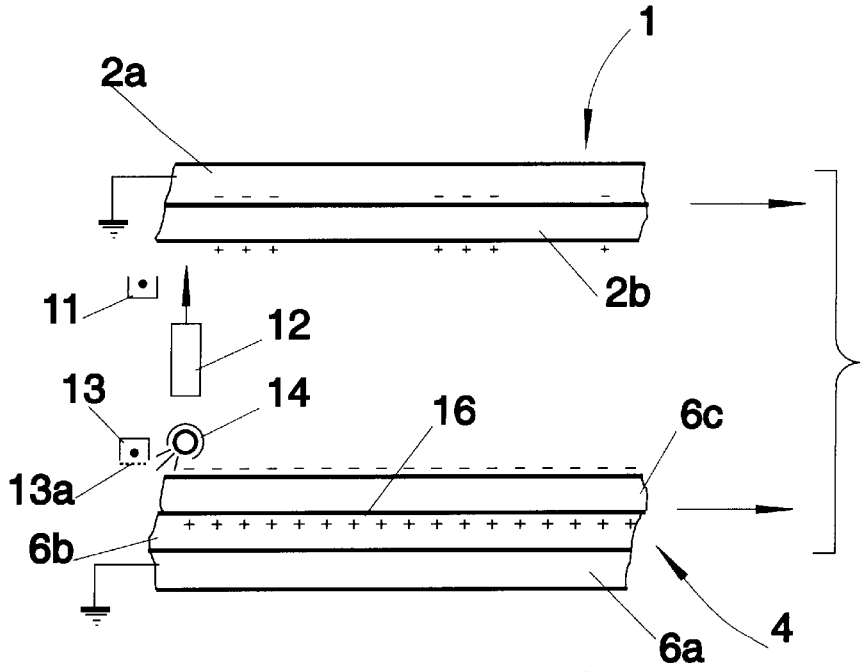
FIGS. 2A to 2C illustrate three sequential steps, respectively, of the process of formation of a latent electrostatic image stage used in the electrophotographic process according to the invention, using the applicable photoreceptor of FIG. 1B.
Figure 2B:
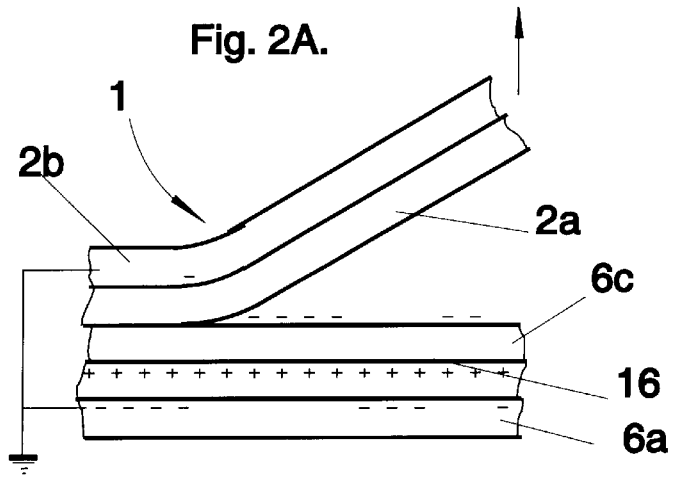
Figure 2C:
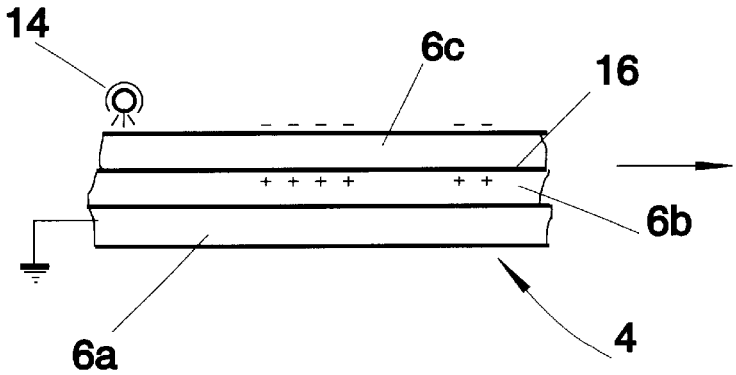

Turning now to FIGS. 2A–2C, there are illustrated three sequential steps, respectively, of a process of formation of a latent electrostatic image on the applicable photoreceptor 4 having the transparent dielectric coating 6*c*. As shown, the conductive substrates 2*a* and 6*a* of the photoreceptors are grounded.

FIG. 2A shows an operational step consisting of reverse electrostatic recording. During this step, an electrostatic image to be copied is recorded on the photosensitive surface 2*b* of the image recording photoreceptor 1, and the dielectric surface of the applicable photoreceptor 4 is charged with a charging device 13 (e.g., corona). The recording of the electrostatic image on the surface 2*b* can be carried out by any known suitable technique utilizing, for example, an exposure system 12 providing analog exposure of a negative image on a positively charged photosemiconductor surface, or a digital recording means. The electrostatic image is in the form of a pattern having spaced-apart image elements (charged regions) spaced by blanked, background regions (uncharged).

Concurrently with the image recording process, charges of the opposite polarities (i.e., negative polarity) are uniformly deposited onto the laminating surface 6*c* of the applicable photoreceptor 4. This is implemented by means of a charging device 13, whose construction and operation are known per se and therefore need not be specifically described except to note that it comprises a grid 13*a* serving for limiting the level of charging. The charging process is accompanied by concurrent illumination of the charging surface with an illumination system 14 (e.g., a lamp).

The passage of light through the laminating layer 6*c* "opens" the photosemiconductor 6*b* causing the injection of charge carriers therein. This results in that positive compensating charges are concentrated on a boundary region 16 defined by the photosemiconductor and dielectric layers 6*b* and 6*c*, thereby creating a time stable state of the uniformly charged surface of the applicable photoreceptor 4.

FIG. 2B shows the next step of interaction between the applicable photoreceptor 4 and the recording photoreceptor 1, during which the surfaces of these photoreceptors (carrying charges of the opposite polarities) are first brought in contact and then disengaged.

Charges on the surfaces of the recording and applicable photoreceptors 1 and 4 are under different conditions. As known, the surface charges deposited on the surface by the corona discharge are loosely connected to this surface (i.e., the surface of the photosemiconductor layer 2*b* of the image recording photoreceptor 1). The bond between these charges and the surface 2*b* takes place only due to the attraction of the deposited charges towards the charges of the opposite polarity induced in the conductive substrate 2*a* of the image recording photoreceptor 1. At the same time, the surface charges on the dielectric layer 6*c* of the applicable photoreceptor 4 are held by the charges of the opposite polarity existing inside the semiconductor layer 6*b*, i.e., on the boundary region 16 between the dielectric and the photosemiconductor layer 6*c* and 6*b*.

During the engagement between the photoreceptors 1 and 4, the positive charges of the recording photoreceptor 1 neutralize the negative charges of the applicable photoreceptor 4 within the regions of the negative image. This results in that a positive mirrored image, formed by negative charges, remains on the surface of the applicable photoreceptor 4. Since both surfaces are in contact, i.e., a gap between them is substantially equal to zero, the interaction between the charges of the opposite polarities can be considered as a charge neutralization process, rather than as an electrical discharge. The compensating negative charges in neutralization zones (within the regions of the negative image) are distributed between the conductive substrates 2*a* and 6*a* of the photoreceptors 1 and 4, proportionally to the values of thickness and dielectric constant of the layers positioned at both sides of the photosemiconductor-dielectric boundary 16 (i.e., layers 6*b* and 6*c*).

Upon disengaging the photoreceptors' surfaces, the remaining compensation charges "flow" from the conductive substrate 2*a* of the recording photoreceptor 1 into the conductive substrate 6*a* of the applicable photoreceptor 4. This equalizes free positive charges at the photosemiconductor-dielectric boundary 16 corresponding to the regions of neutralization of the surface charges. Since the remaining surface charges of the applicable photoreceptor 4 are held by inner charges of the opposite polarity, they are not transferred to the photosemiconductor surface 2*b* of the recording photoreceptor 1.

Thus, in distinction to the above-indicated TESI process, the electrophotographic process according to the invention does not cause redistribution of the surface charges between the contacting surfaces resulting from the charge transfer. The invented process utilizes an applicable photoreceptor as an intermediate information carrier, and provides mutual charge neutralization at certain regions and fixation of the obtained electrostatic image on this intermediate information carrier. This principal difference enables to form potential relief of the latent electrostatic image on the intermediate information carrier without distortion and in a manner preserving contrast and resolution of the recorded image, providing high quality of the half-tone transfer.

FIG. 2C shows the final stage of the illumination of the photosensitive layer of the applicable photoreceptor 4 after the disengagement of the photoreceptors' surfaces 2*b* and 6*c*. At this stage, the potential relief of the latent electrostatic image is finally formed on the applicable photoreceptor 4 (i.e., the intermediate information carrier). Inner positive charges of the photosemiconductor layer 6*b*, in the spaces between spaced-apart image elements, are neutralized by the negative charges of the substrate due to the photocurrent. The so obtained potential relief has a stable state, and as a result, the latent electrostatic image formed on the dielectric surface 6*c* of the applicable photoreceptor 4 can be stored for a long period of time, which is the requirement enabling the process of multiple-copy production from a single exposure.

Turning back to FIG. 2B, during the process of interaction of the photoreceptors, the charge contrast is formed on the dielectric surface 6*c* of the applicable photoreceptor in the absence of light. This fact eliminates the influence of the dielectric coating thickness on the resolution of the latent electrostatic image, whilst revealing the potential relief at the next stage of the general illumination (FIG. 2C). This is due to the fact that the distribution of charges of the opposite polarity in the boundary photosemiconductor-dielectric 16 will proceed during the stage of general illumination, strongly in accordance with the distribution of the surface charges.

As for the known processes of direct recording on a photoreceptor having a transparent dielectric coating, initially, the charge contrast formation takes place on the boundary photosemiconductor-dielectric, carried out at the stage of exposure through the transparent dielectric layer. The formation of the surface charge contrast takes place at the second stage. Such a sequence is associated with that the distribution of the surface charges proceeds in accordance with that of the boundary photosemiconductor-dielectric. Therefore, in the known processes, only thin-film dielectric coatings are usually employed (e.g., in the apparatuses commercially available from Canon). In the electrophotographic recording method according to the invention, the thickness of the coating and its transparency are not the limiting factors defining the formation of the latent electrostatic image.

According to the invented method, the level of potential relief is determined by the level of the initial charging of the applicable photoreceptor, and does not depend on the exposure conditions. By this reason, photosemiconductor layers having a relatively low photo-sensitivity and, consequently, a low dark conductivity can be used in the applicable photoreceptor. This enables to obtain prolonged preservation of the charged image on the intermediate information carrier. Moreover, this significantly reduces the requirements to the spectral characteristics of the photosemiconductor being used.

At the final stage of copying, the illumination of the photosemiconductor surface of the recording photoreceptor as well is desired. This allows not only for removing the residual charges from this surface, but also for reducing the "fatigue" of the photosemiconductor layer.

A direct electrostatic recording of the image to be copied may be carried out on the photosensitive surface of the applicable photoreceptor as well. To this end, for obtaining a copy similar to the original, it is necessary to use reversal development.

Hence, should the copying process be implemented in accordance with the "positive-positive" scheme, either the reverse recording of the original is to be produced during the exposure process, or the direct recording should be carried out with the use of reverse development. If the copying process has to utilize a "positive-negative" scheme or a "negative-positive" scheme, the provision of the direct recording of the image to be copied is sufficient.

The above-described example of the process of formation of the latent electrostatic image on the applicable photoreceptor relates to the photoreceptor 4 having a transparent dielectric coating 6*c*. The process would be generally the same when using the applicable photoreceptor 8 having the opaque dielectric coating 10*d* (FIG. 1C). The only difference consists of that, the illumination at the stage of charging the applicable photoreceptor and the illumination of its photosensitive layer 10*c* at the final stage, are carried out from the inside, through the transparent basis 10*a* and semitransparent conductive layer 10*b*.

Figure 3A:
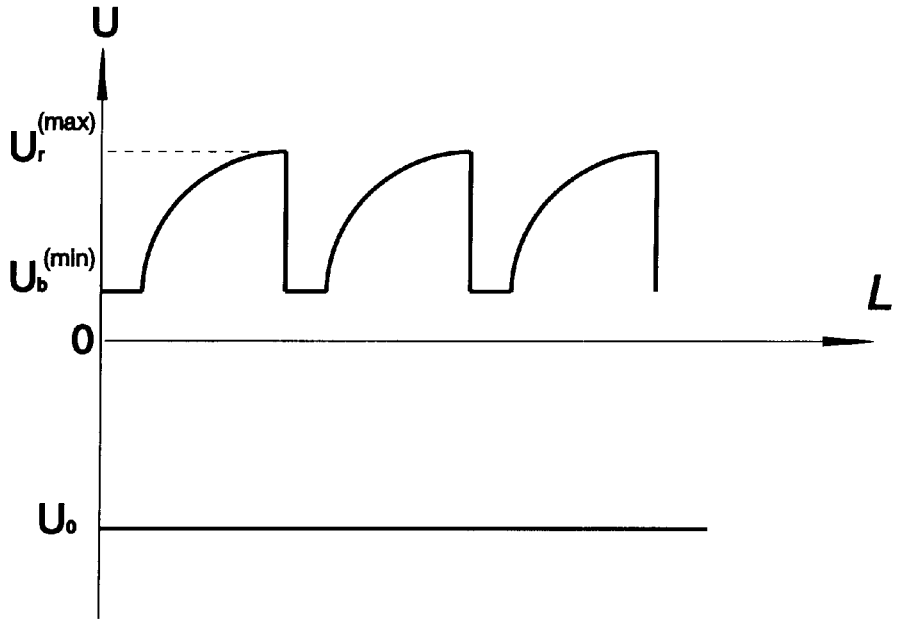
FIGS. 3A and 3B graphically illustrate changes of potential level during the latent electrostatic image formation stage shown in FIGS. 2A–2C.
Figure 3B:
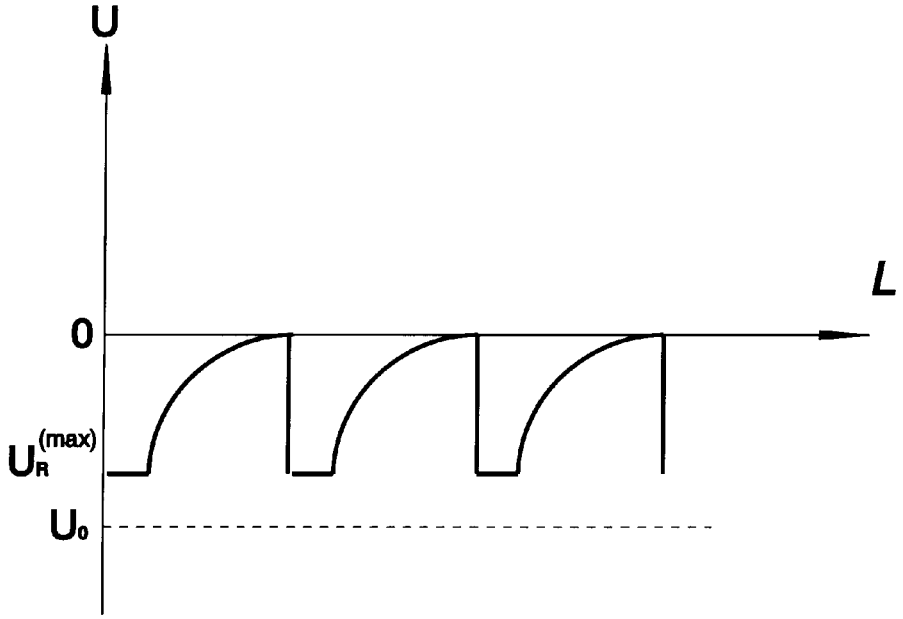

FIGS. 3A and 3B illustrate, in a simplified manner, the process of formation of the latent electrostatic image on the applicable photoreceptor (4 or 8), when utilizing analog optical scanning of the image to be copied. FIG. 3A shows an arbitrary configuration of the potential relief U corresponding to the density of surface charges of the negative latent electrostatic image on the recording photoreceptor in one of the directions l of the surface of its contact with the applicable photoreceptor. In the figure, $U^{(max)}_r$ is the maximal value of the recording level; $U^{(min)}_r$ is the minimal value of the recording level defining the background level; $U_0$ is the initial potential level of charging the applicable photoreceptor; wherein $|U_0|=|U^{(max)}_r|$. FIG. 3B shows the configuration of the potential relief U of the positive latent electrostatic image formed on the surface of the applicable photoreceptor after the final stage of the electrophotographic process.

The substrates of both photoreceptors are grounded, i.e., there is no potential difference between them. Accordingly, the voltage in the zone of contact of the photoreceptors is determined by the potentials of the positively charged image of the recording photoreceptor and by the negatively charged surface of the applicable photoreceptor. As the result, for the value of the obtained potential level $U_a$, we have:

$$U_a=U_0-U^{(min)}_r$$

The above expression shows that the invented electrophotographic process enables a more effective use of the abilities of the photosemiconductor layer of the recording photoreceptor, because it excludes the influence of the background of the recorded image on the quality of the printed copy. Moreover, reduction of the potential level $U_a$ facilitates the time preservation of the charges of the applicable photoreceptor.

The ratio of the photoreceptors' charging potentials determines the levels of the potential relief and background at the blanked regions of the latent electrostatic image (i.e., spaces between the image elements) formed on the intermediate information carrier (applicable photoreceptor). In the present example, when $|U_0|=|U^{(max)}_r|$, the background level is reduced to zero, and the potential level of the obtained latent electrostatic image is equal to the contrast of the initially recorded image, that is:

$$|U_a|=|U^{(max)}_r-U^{(min)}_r|$$

The value $U_0$ at a given value of $U^{(max)}_r$ can be used for regulating the level of the potential relief $U_a$, and, correspondingly, the background level on the intermediate information carrier.

Figure 4A:
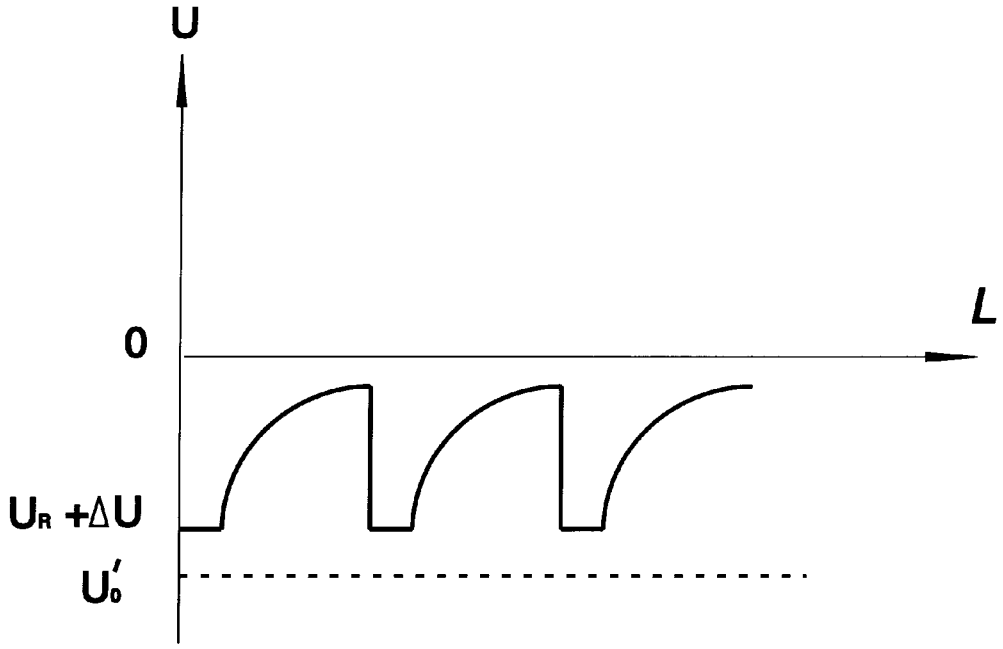
FIGS. 4A and 4B graphically illustrate the potential relief levels under different conditions, respectively, of the latent electrostatic image formation.
Figure 4B:
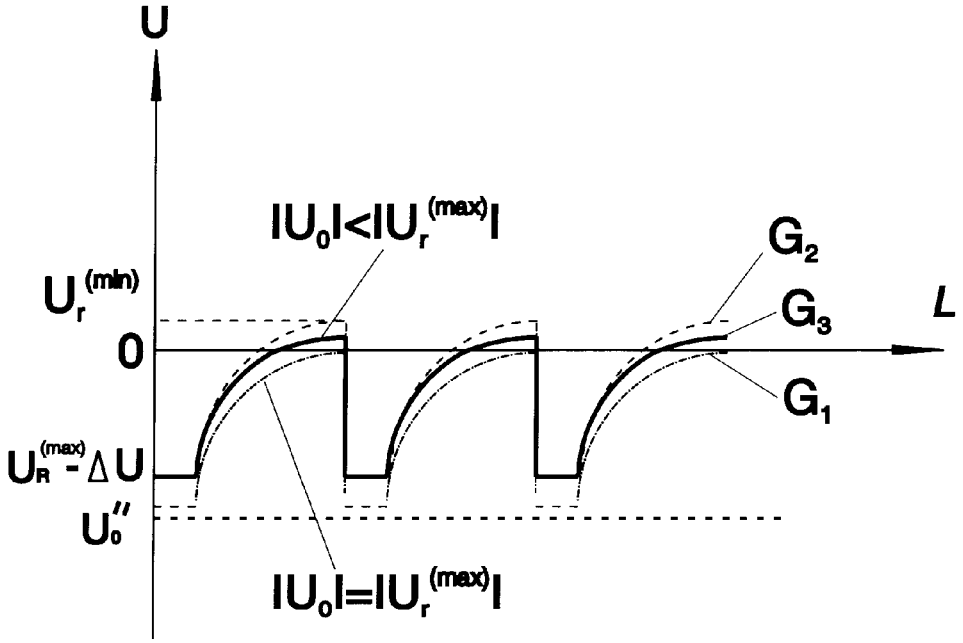

FIGS. 4A and 4B illustrate diagrams corresponding to different potential levels of the formed latent electrostatic image. FIG. 4A shows an example of increasing the initial level of charging the applicable photoreceptor on $\Delta U$ under the condition when $|U'_0|>|U^{(max)}_r|$, wherein $U'_0=U_0+\Delta U$. In this case, the configuration of the potential relief does not change, and the background level of the latent electrostatic image increases on the value $\Delta U$. FIG. 4B shows an example of decreasing the initial charging level of the applicable photoreceptor on the value $\Delta U$ under the condition when $|U''_0|<|U^{(max)}_r|$, wherein $U''_0=U_0-\Delta U$. In this case, since free positive surface charges remain in the blanked regions of the image being formed, partial redistribution of these charges occurs between the interacting surfaces of the photoreceptors. This redistribution depends on the ratio of the remaining surface charges on the surface of the recording photoreceptor and the charges of the same polarity in the boundary photosemiconductor-dielectric of the applicable photoreceptor.

A decrease in the initial charging level of the applicable photoreceptor to the value $U_0$ satisfying the condition $|U_0|<|U^{(max)}_r|$, leads to a decrease in the optical density and to the distortion of the half-tone image on the copy. This is a result of the decrease in the general potential level and recharging of the potential relief regions corresponding to low optical density of the image exceeding the optical density of the blanked regions of the original. (For comparison, graph $G_1$ shows the non-distorted potential relief with $|U_0|=|U^{(max)}_r|$). However, such an operational mode can be used for copying line art (binary) originals, as well as when using digital recording means in an optical system for scanning the image under copying. Here, the opposite polarity at the blanked regions can be considered as a positive factor in several cases, e.g., under the reverse development or under development without any bias voltage in a developer tool.

Diagrams of FIGS. 4A and 4B also show the possibilities of the invented electrophotographic process to control the potential relief level of the latent electrostatic image up to the changes in the polarity of charges at the blanked regions of the image. This advantage is essential when using digital recording means. Moreover, the invented process opens wide perspectives in controlling the copying process by changing the realization conditions of its different stages.

Figure 5:
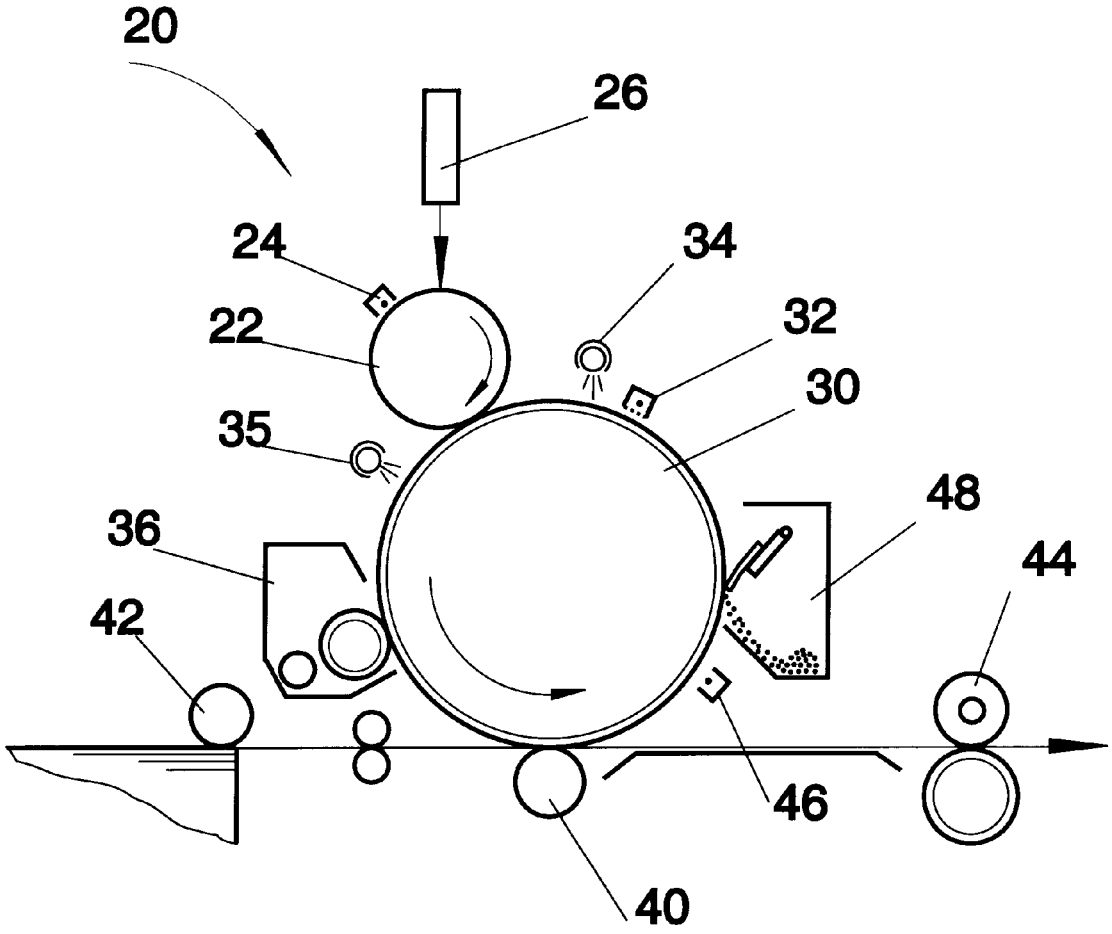
FIG. 5 schematically illustrates an electrophotographic apparatus constructed according to one embodiment of the invention, utilizing the applicable photoreceptor of FIG. 1B and operating in a single-copy mode.

FIG. 5 illustrates an example of an electrophotographic apparatus 20 for carrying out the above-described invented method when operating in the single-copy mode. The apparatus 20 comprises the following main constructional parts: a cylindrical recording photoreceptor 22; a charging device 24; an exposure tool 26; a cylindrical applicable photoreceptor 30; a scorotron-type charging device 32; illuminators 34 and 35; a magnetic, brush-based developer tool 36; a contact transfer device 40; a feeding device 42 for feeding a sheet-like material (e.g., a paper) constituting a final information carrier; a thermal-power fixing tool 44; a charge neutralization device 46; and a cleaning device with an elastic blade-like cleaner 48.

In the present example, the applicable photoreceptor 30 is of the kind having a photosemiconductor layer laminated by a transparent dielectric film (i.e., the photoreceptor structure 4 of FIG. 1B). The recording photoreceptor 22 is mounted for radial movement between its inoperative and operative positions, so as to provide a gap between the photoreceptor 22 and 30 in the inoperative position of the photoreceptor 22. The transfer device 40 and the blade-like cleaner 48 are also displaceable between their operative and inoperative positions, depending on the operating mode of the apparatus 20. The circumference length of the applicable photoreceptor 30 is selected in accordance with the constructional considerations depending on the length of the maximal format copy (the copy size along its movement). This is the necessarily condition for enabling the multiple- copy production mode.

During the operation of the apparatus 20, the photosemiconductive surface of the recording photoreceptor 22 is charged, for example, by the positive corona 24, after which a negative image of the original is projected onto the charged photosemiconductive surface by the exposure tool 26. By this time, a negative charge is evenly deposited onto the cleaned dielectric surface of the applicable photoreceptor 30. This is carried out by the simultaneous operation of the scorotron 32 and the illuminator 34 illuminating the surface being charged. Thereafter, along with the movement, the working surfaces of both photoreceptors 22 and 30 pass the contact zone (which should be isolated from light), and are then illuminated. The process of recording the negative latent image on the surface of the recording photoreceptor 22 and the process of formation of the positive latent electrostatic image on the surface of the applicable photoreceptor 30 proceed continuously.

This having been accomplished, the laminated surface of the applicable photoreceptor 30 carrying the latent electrostatic image, first enters the zone of image development and then the zone of image transfer, in which the developed image is transferred onto the paper (final information carrier). The so-obtained copy further passes through the fixing tool 44, while the cleaner 48 removes the residuals of the non-transferred developer from the previously neutralized surface of the applicable photoreceptor 30. To produce a next copy in the single-copy operational mode of the apparatus 20, the entire cycle is repeated.

Since the recording photoreceptor 22 is technologically disconnected from the devices for the subsequent realization of the duplication process, the photoreceptor 22 may have minimal possible dimensions. This enables the path between the exposure zone and the zone of contact of the photoreceptors to be reduced, and consequently, enabled to reduced the time interval between the process of image recording formation on, respectively, on the surface of the applicable photoreceptor 30 are reduced. Under these conditions, even those photosemiconductors, which are rapidly "fatigued" and highly sensitive and have high dark potential decay, can be used in the recording photoreceptor 22. This is practically impossible under the conditions of the known electrophotographic processes for producing a plurality of copies.

It should be noted that in the case that a negative copy is to be produced, the polarities of the photoreceptor charging remain unchanged, and a positive latent electrostatic image is recorded on the recording photoreceptor 22. Hence, when using for example digital recording means, the same apparatus with the same developer could be used for producing either positive or negative prints from one original.

Figure 6:
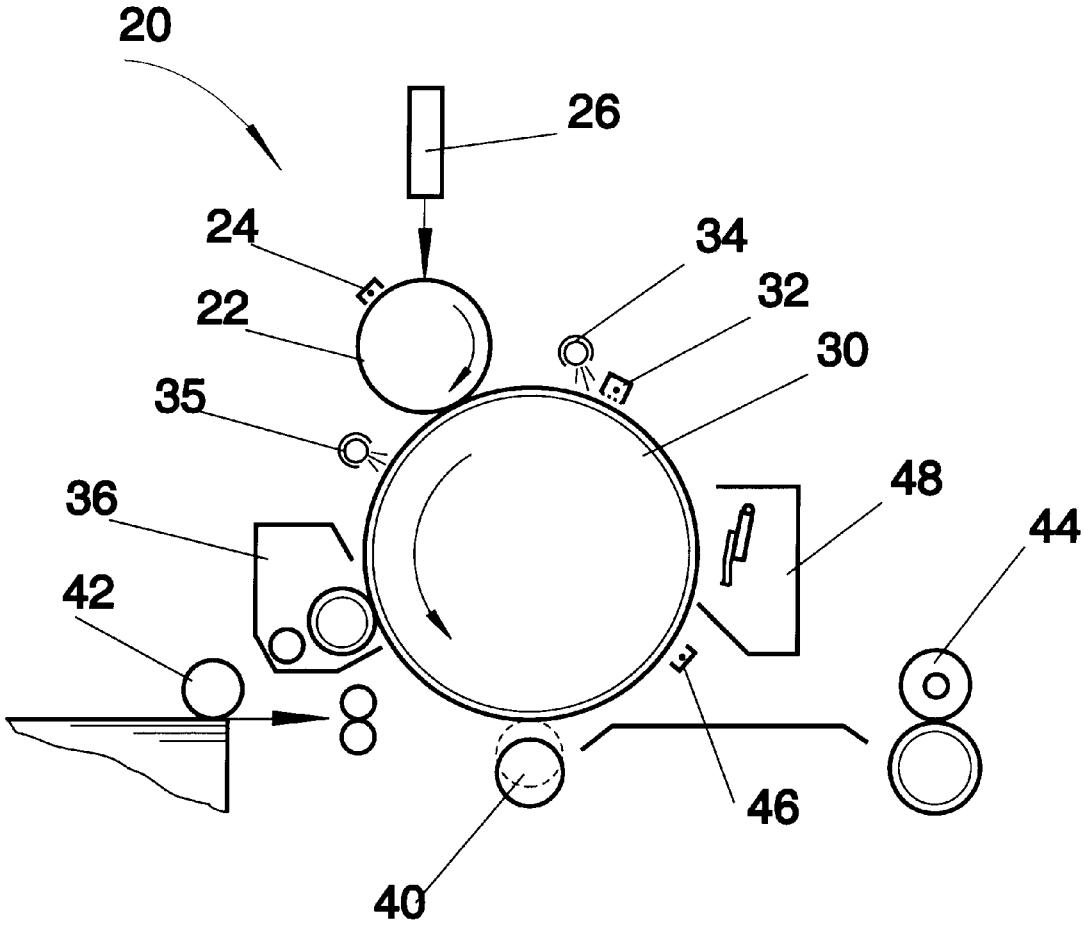
FIGS. 6 and 7 illustrate the electrophotographic apparatus of FIG. 5 in its two operational positions when producing the first copy of a plurality of copies (multiple-copy mode of operation)
Figure 7:
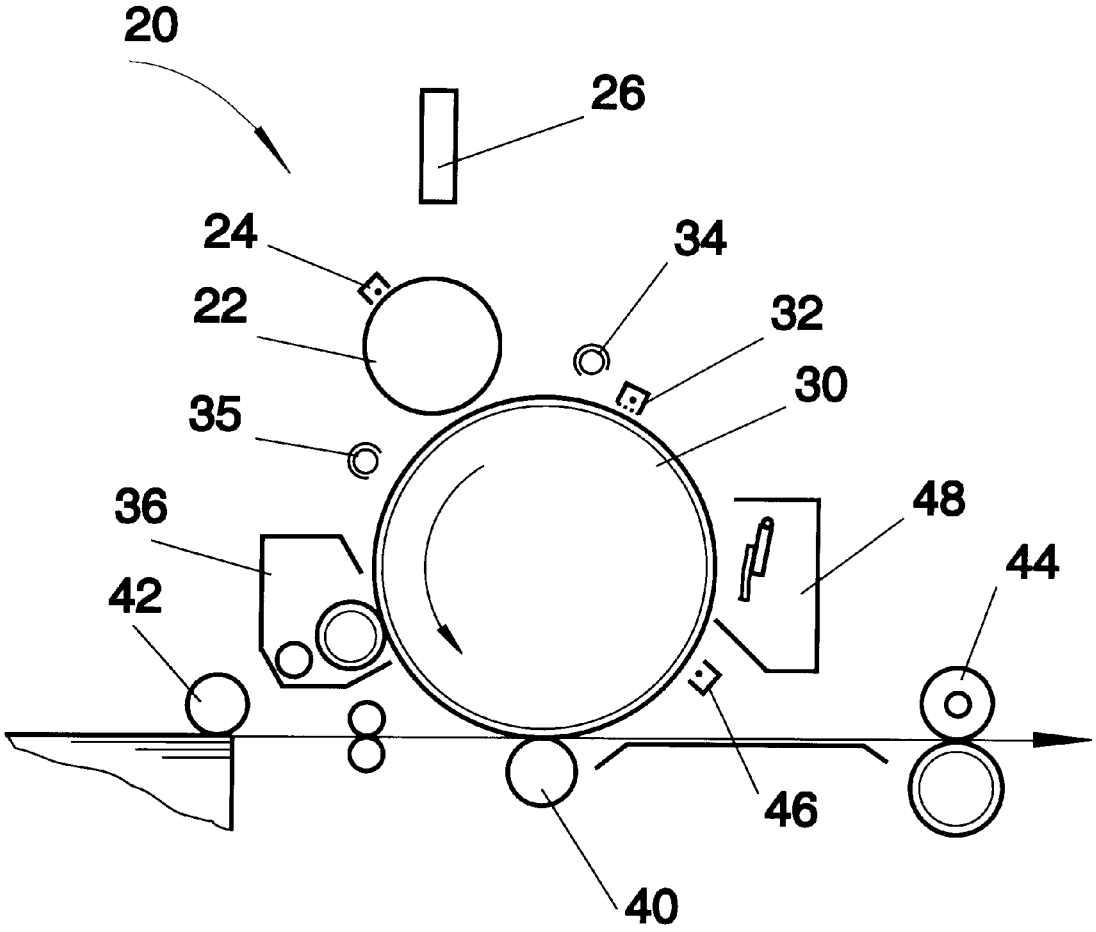
Figure 8:
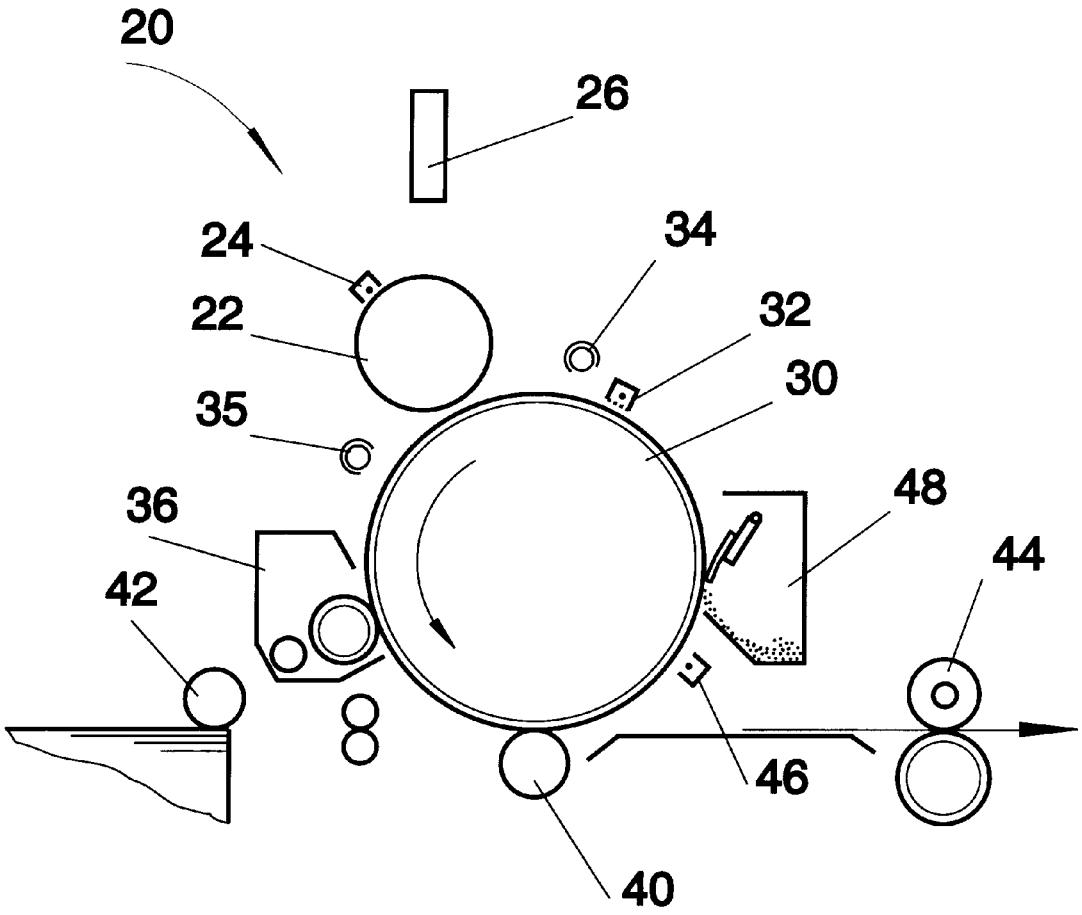
FIG. 8 is a schematic illustration of the electrophotographic apparatus of FIG. 5 when producing the last copy of the plurality of copies.

FIGS. 6, 7 and 8 show sequential operational steps of the apparatus 20 operating in a multiple-copy production mode. In the operational step of FIG. 6, the apparatus 20 operates in the mode of formation of the latent electrostatic image on the intermediate information carrier 30, whilst producing a first copy from the plurality of copies. In this mode, according to the cyclogram of the apparatus' operation, in addition to the operation of both photoreceptors 22 and 30, the charging devices 24 and 32, illuminators 34 and 35, exposure tool 26 and developer tool 36 are switched on. The transfer device 40 and the cleaning device 48 are brought onto their inoperative positions, and the charge neutralization device 46 is switched off.

The process of formation of the latent electrostatic image on the intermediate information carrier 30 is performed in the same sequence of operational steps as in the above-described single-copy mode. In a case that, the processes of recording of the latent electrostatic image and copying are timely separated, the production of the first copy can be started in the multiple-copy production mode.

In FIG. 7, the apparatus 20 operates in the multiple-copy production mode, wherein in addition to the operation of the applicable photoreceptor 30 and the transfer device 40 brought closer to the photoreceptor 30, only the developer tool 36, feeding device 42 and fixing tool 44 are put in operation. In this case, the recording photoreceptor 22 is brought into its inoperative position, i.e., moved away from the surface of the applicable photoreceptor 30. Since the charge forming the latent electrostatic image on the surface of the applicable photoreceptor 30 practically retains its initial value, the copying process is significantly simplified and becomes similar to the process of direct printing, as it proceeds, for example, in an offset duplicator (roto-printer).

FIG. 8 illustrates the apparatus 20 whilst operating for producing the last copy of the plurality of copies. In accordance with the cyclogram of the apparatus' operation, the transfer device 40 is moved away from the surface of the applicable photoreceptor 30 after the production of the last copy. At this stage, the neutralization device 46 is switched on, and the blade-like cleaner 48 is brought in contact with the surface of the applicable photoreceptor 30 to be cleaned. This completes the copying process.

If desired, the copying process can be timely interrupted, and, after some time, continued in accordance with a predetermined program. In any case, the processes of the neutralization and cleaning are carried out during the production of the last copy of the given plurality of copies, after which the apparatus is ready for copying a next original.

Figure 9:
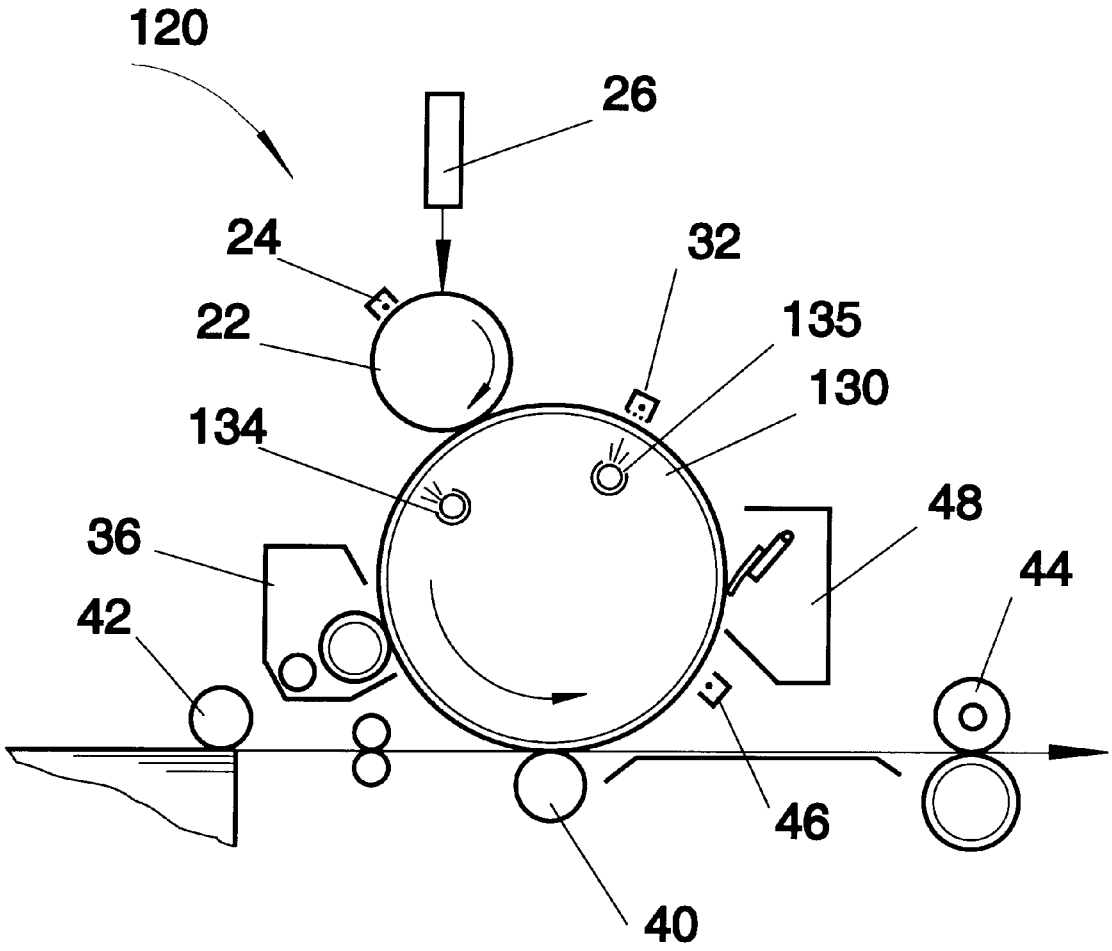
FIG. 9 is a schematic illustration of an electrophotographic apparatus with the applicable photoreceptor of FIG. 1C and operating in a single-copy mode.

FIG. 9 illustrates an electrophotographic apparatus 120 according to another embodiment of the invention. The apparatus 120 is designed generally similar to the apparatus 20, but has a somewhat different construction of its applicable photoreceptor. To facilitate understanding, the same reference numbers are used for identifying those components, which are identical in the apparatuses 20 and 120. In the apparatus 120, an applicable photoreceptor 130 has a transparent base and an opaque dielectric coating. Accordingly, the illuminators 134 and 135 are accommodated inside the cylindrically shaped applicable photoreceptor 130. It is understood that during the process of formation of the latent electrostatic image on the dielectric surface, the illumination of the photosensitive layer is carried out from the inside of the transparent base, through the semi-transparent conductive metallized layer.

The potential level of the latent electrostatic image formed on the surface of the intermediate information carrier is determined by the initial level of charging and does not depend on the spectral characteristics of the laminated photosemiconductor layer. For this reason, the applicable photoreceptor can be manufactured from inexpensive, low-sensitive photosemiconductor materials having high dark resistance, and consequently, a slower potential decay that simplifies the maintenance of the stability of the potential relief during the copying process. For example, a layer of amorphous selenium without any sensitization additions can be used. Due to mechanical, electric and chemical stability of the dielectric coating, the life-time of the applicable photoreceptor is significantly increased.

The photosemiconductor surface of the recording photoreceptor practically does not undergo any mechanical effects during the process of copying. This provides the longevity and reduces the service costs of the photosemiconductor surface. Additionally, this reduces requirements with photosemiconductor properties and mechanical characteristics of photosemiconductor materials, thereby enabling use of a great variety of materials in the manufacture in the image of recording of photoreceptor.

Eliminating the use of electrizators in the copying process reduces ozone emission to a minimum during the copying. This improves the working conditions of the apparatus, does not require the application of special protection means in the apparatus and increases the lifetime of many constructional elements.

The maintenance of the required potential level of the latent electrostatic image during the entire process of production of the plurality of copies, is the main condition of the successful copying process. As indicated above, due to the passive discharge of the applicable photoreceptor caused by the dark current in the photosemiconductor, and due to the active discharge of the applicable photoreceptor under external effects, the reduction of the surface potential may occur. In cases where the potential level decreases to a limit value, it should be corrected in a manner to be desirably increased. In other words, a compensating recharging of the developing surface of the photoreceptor is required in these cases.

However, if the latent electrostatic image is formed as a potential relief (for example by means of analog optical system utilizing amplitude modulation of the optical densities of the copying images), then each optical density has a corresponding relative value of the potential on the surface of the photoreceptor. In this case, dynamics of time changes in different regions of the potential relief are unequal and depend on the initial potential value. Hence, the recharging will lead to distortion in the reproduced optical densities of a half-tone image. Therefore, the most effective method of recharging can be applied for reproducing stroked originals, or for using digital recording means with frequency modulation of radiation. In this case, the potential level at the regions corresponding to different optical densities of the copying image is the same. Consequently, the change in the general potential level will not lead to changes in the ratio of the reproduced optical densities.

Since the reasons for passive and active discharge are different, and the discharging processes proceed differently, methods of compensating recharging of the applicable photoreceptor differ from each other.

Figure 10A:
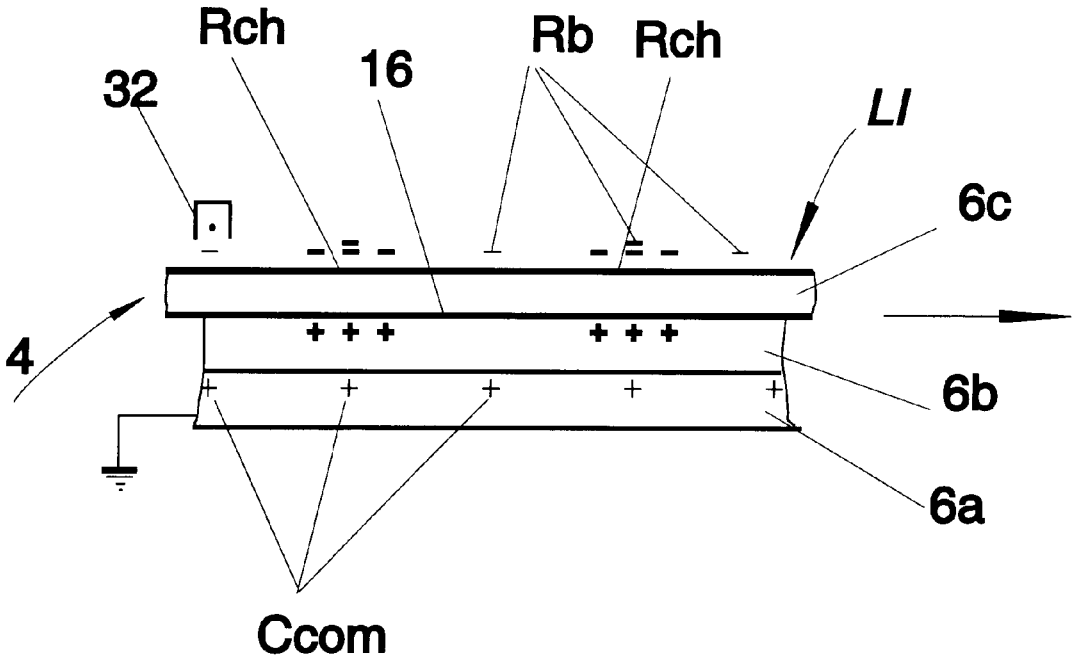
FIGS. 10A and 10B illustrate a process of recharging the photoreceptor of FIG. 1B during its passive discharge.
Figure 10B:
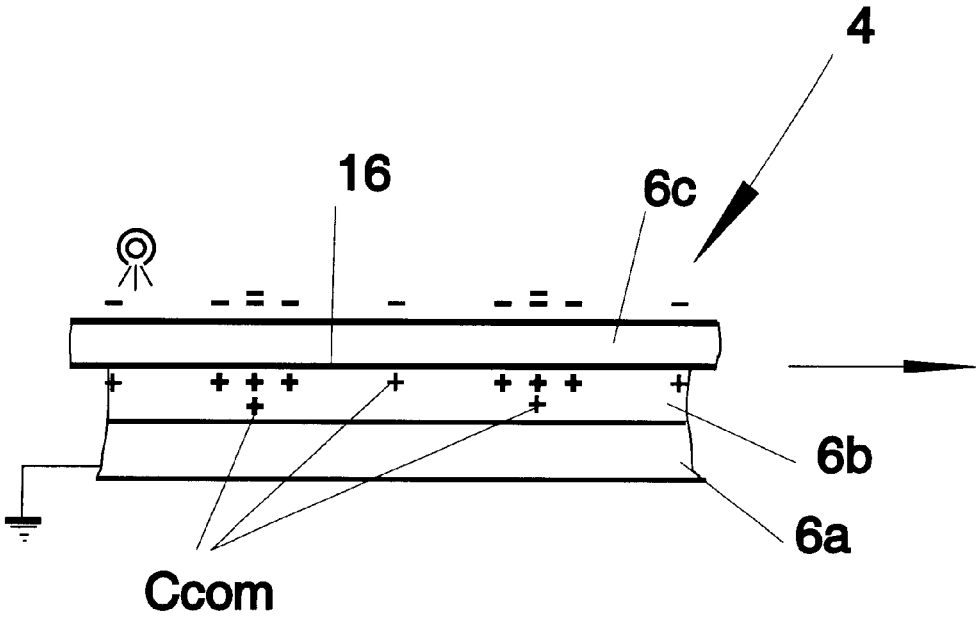

FIGS. 10A and 10B illustrate stages of the process of recharging the applicable photoreceptor 4 (constructed as described above with reference to FIG. 1B, i.e., having the transparent dielectric coating 6*c*) in the case of its passive discharge. With the passive discharge resulting from the dark discharge in the photosemiconductor layer 6*b*, the amount of charges on the boundary photosemiconductor-dielectric 16 reduces, and the electrical bind between these charges and the surface charges that have thereby become excessive, breaks down. Therefore, the excessive charges freely flow away from the surface of the dielectric 6*c*. In this way, a simultaneous reduction of the surface potential, and equivalent thereto charge contrast on the boundary photosemiconductor-dielectric 16, takes place.

As shown in FIG. 10A, at the first stage of recharging in the field of corona discharge 32, an even deposition of unipolar charges $C_{dep}$ (negative charges in the present example) onto the dielectric surface 6*c* of the photoreceptors 4 is performed. This dielectric surface 6*c* carries the latent electrostatic image LI. The charges $C_{dep}$ are deposited both on charged regions $R_{ch}$ corresponding to the image elements and on blanked background regions $R_b$. Compensating charges $C_{com}$ of the opposite polarity are induced in the electrically conductive substrate 6*a* of the photoreceptor 4.

As shown in FIG. 10B, at the next illumination stage, these compensating charges $C_{com}$ move towards the boundary photosemiconductor-dielectric 16, resulting in that the latent electrostatic image LI with the corrected potential level has a stable equilibrium state. It should be noted that the dosage of charge precipitating on the dielectric surface 6*c* of the photoreceptor 4 is regulated, for example, by the corona electrolizer current.

When dealing with the photoreceptor structure 8 (FIG. 1C) having opaque dielectric coating, the process of recharging is carried out in a similar manner, but differing in that the illumination is performed from the side of the semitransparent electrically conductive layer (10*b* in FIG. 1C).

Figure 11A:
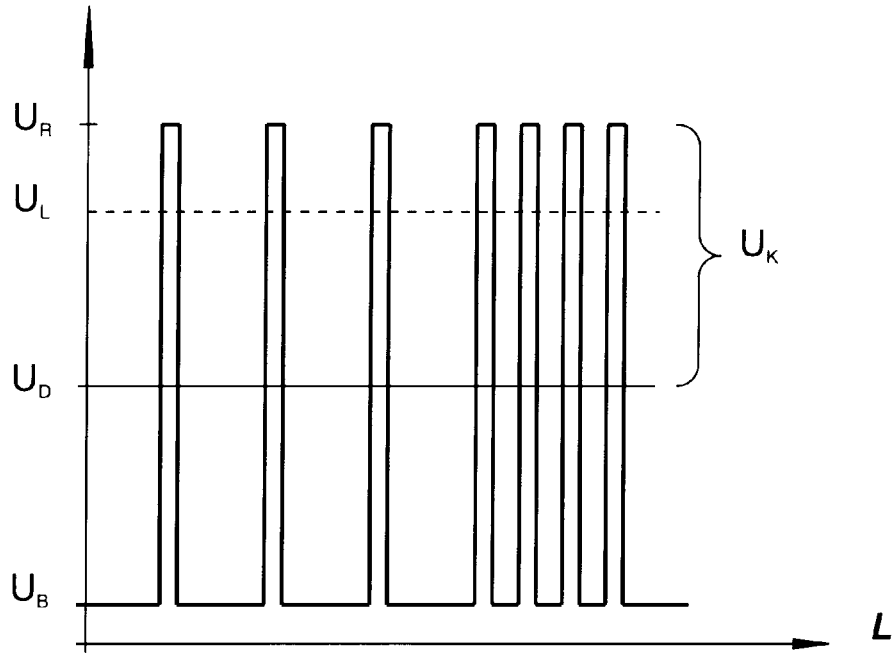
FIGS. 11A to 11D illustrate a method of maintaining the potential level of a latent electrostatic image during the passive discharge of the photoreceptor.

FIGS. 11A–11D present diagrams of a method of maintaining the potential level of the latent electrostatic image, in the case of passive discharge of the applicable photoreceptor. FIG. 11A shows the initial state of recording produced by digital means with the frequency modulation of radiation. Here, $U_R$ is the initial potential level of the latent electrostatic image in an arbitrary direction l on the surface of the photoreceptor (upper level of recording); $U_L$ is the minimal (limit) value of the potential level, providing high quality development at a given technological speed of the copying process and certain triboelectrical properties of the developer (for a concrete system, $U_L$=Const); $U_D$ is the bias voltage supplied to a counter-electrode of the developer tool. In real conditions, we have $|U_D|<|U_L|$ and, consequently, the relationship $|U_D|>|U_B|$ always takes place, wherein $U_B$ is the background level of the potential relief (lower level of recording).

Electrostatic contrast UK under development is determined as the potential difference, i.e., $U_K=U_R-U_D$. As known, to provide high-quality development, it is desired to create such conditions that $U_K\approx$Const. This can be achieved by correcting the bias voltage value $U_D$ in accordance with changes in the potential level $U_R$ of the latent electrostatic image, by using either a tracking system or a predicting program. At the same time, if the changes in the potential level are within the allowable limits, namely if these changes do not cause a noticeable deterioration of the copy image, the bias voltage value $U_D$ can be kept constant.

Figure 11B:
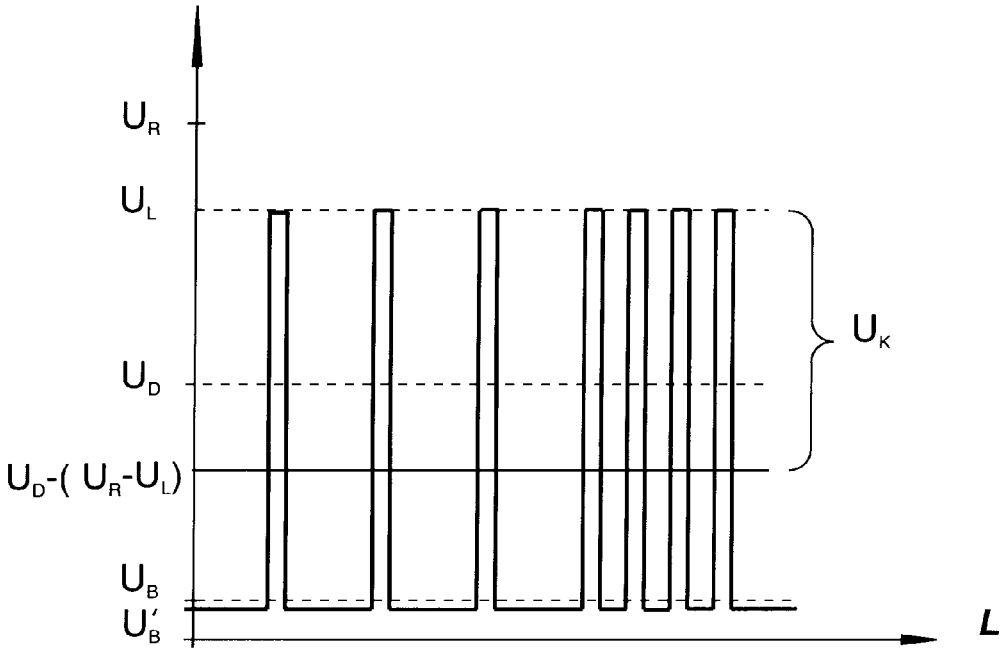

FIG. 11B shows changes in the upper and lower levels of the initial potential relief resulting from the discharge of the photoreceptor. Owing to the fact that the dark discharge of the photosemiconductor layer has an exponential nature, the time decay of the upper potential level is more intensive, as compared to that of the lower potential level. During the decay of the upper potential level to the value $U_L$, the background level is reduced insignificantly to the value $U'_B$. To satisfy the condition of $U_K$=ConSt, the bias voltage in the developer tool should be reduced on the value $(U_R-U_L)$.

Figure 11C:
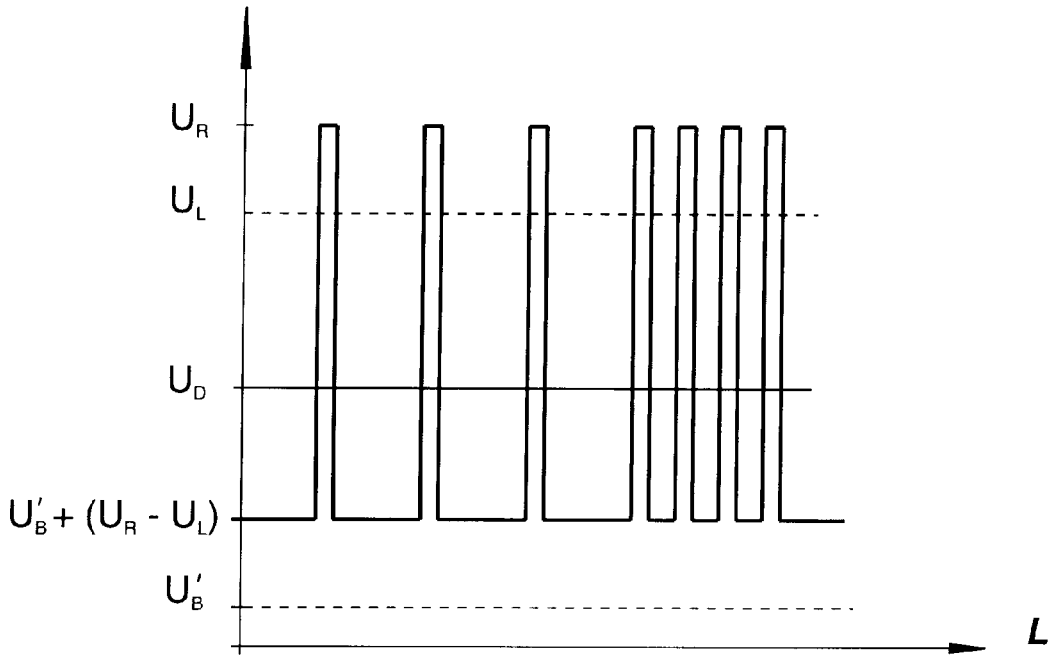

FIG. 11C illustrates changes in the upper and lower levels of the potential relief after the recharging process. For simplicity, it is assumed that the recharging is carried out under the conditions of even deposition of the charge carriers onto the surface of the photoreceptor, resulting in that the increase of the upper and lower levels are the same. Practically, the evenness of the deposition at some extent depends on the value of the surface potential. The diagram shows the potential levels after recharging with the value equal to the previous maximally allowed potential decay $(U_R-U_L)$.

Figure 11D:
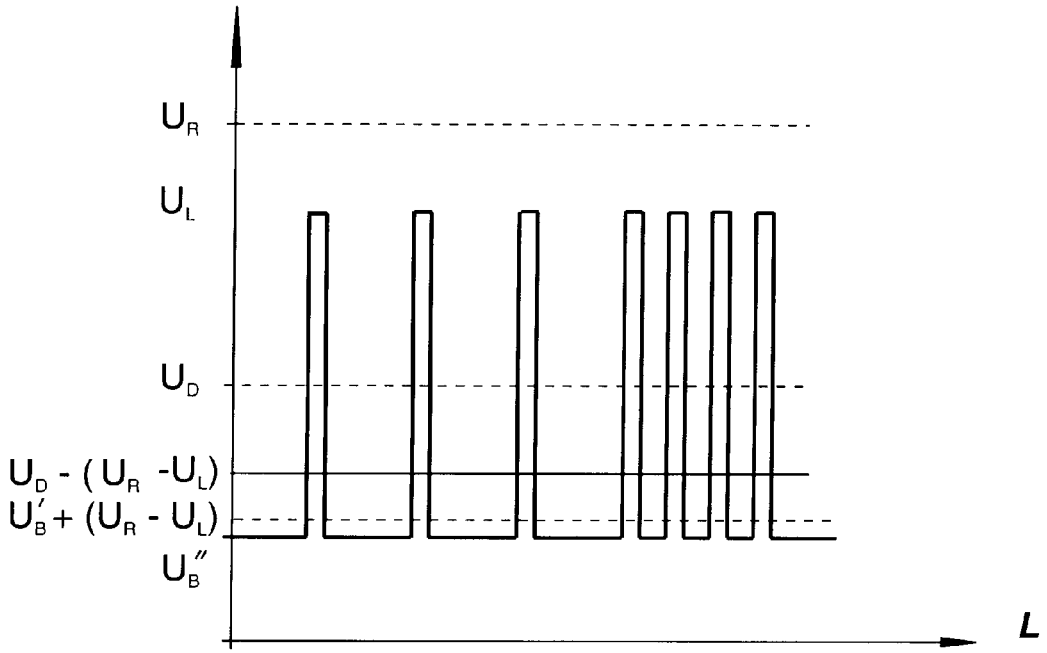

FIG. 11D illustrates a secondary decay of the upper and lower levels of the potential relief during the process of discharge of the photoreceptor. Since the background level is reduced insignificantly, its growth caused by recharging will gradually lead to its approaching the correctable level of the bias voltage, which, as indicated above, should always exceed the background level. This condition limits the repeatable recharging process.

In the case of passive discharge of the photoreceptor, a number, n, of possible episodical recharging procedures, can be determined as dependent on the given interval of potential level oscillations and on the value of bias voltage, in accordance with the following equation:

$$n = \frac{U_L - U_K}{U_R - U_L}$$

If $U_D$=Const, we have:

$$n = \frac{U_D}{U_R - U_L}$$

The above-described process of recharging can be used not only in the cases of passive discharge of the applicable photoreceptor, but also in cases when the initial potential level of recording is less than the required value. This will enable to create necessary conditions for the developing process, and will also provide a "stock" in the value of the initial potential level prior to the copying process. Moreover, the conditions of formation of the latent electrostatic image are thus simplified.

Figure 12A:
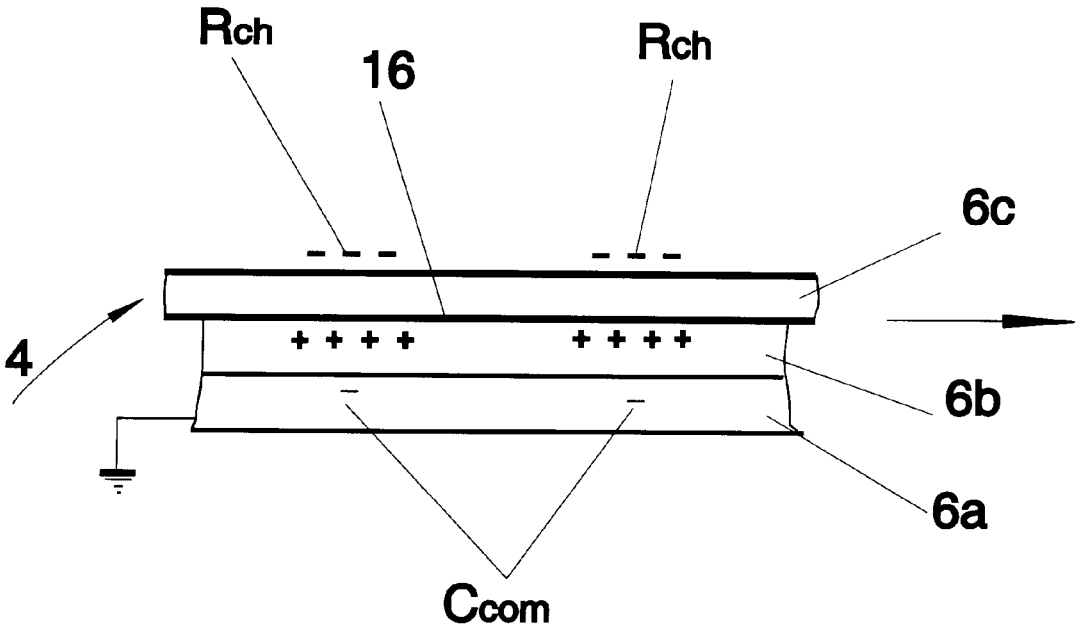
FIGS. 12A and 12B illustrate a process of recharging the photoreceptor during its active discharge.
Figure 12B:
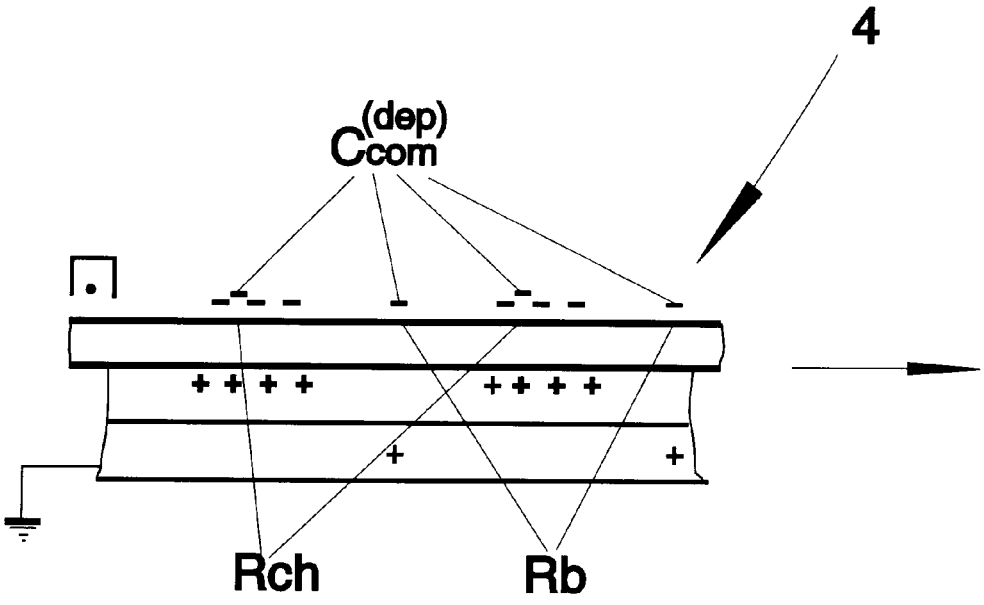

FIGS. 12A and 12B illustrate a process of recharging the photoreceptor 4 having the dielectric coating 6*c* in the case of active discharge. FIG. 12A shows redistribution of charges after the active discharge of the surface of the photoreceptor resulting from external effects occurring during the copying process. In distinction to the case of passive discharge, here, the reduction of the surface potential is accompanied by storage of the charge contrast on the boundary photosemiconductor-dielectric 16 for some time, while the compensating charges $C_{com}$ (of the amount corresponding to the reduction of the surface charges) are induced in the electrically conductive substrate 6*a*.

FIG. 12B shows the charged state of the photoreceptor 4 after the external recharging thereof in darkness by means of uniform deposition of the negative compensating charges $C^{(deP)}_{com}$ of a given value within the entire surface of the photoreceptor. The regions $R_{ch}$ of the latent electrostatic image are recovered and take a stable equilibrium state, while unstable external polarization appears in the charged blanked regions $R_b$, resulting in that these regions are rapidly discharged during the copying process.

The process of such recharging can be applied when using the photoreceptor with any dielectric coating, irrespective of its transparency.

Figure 13:
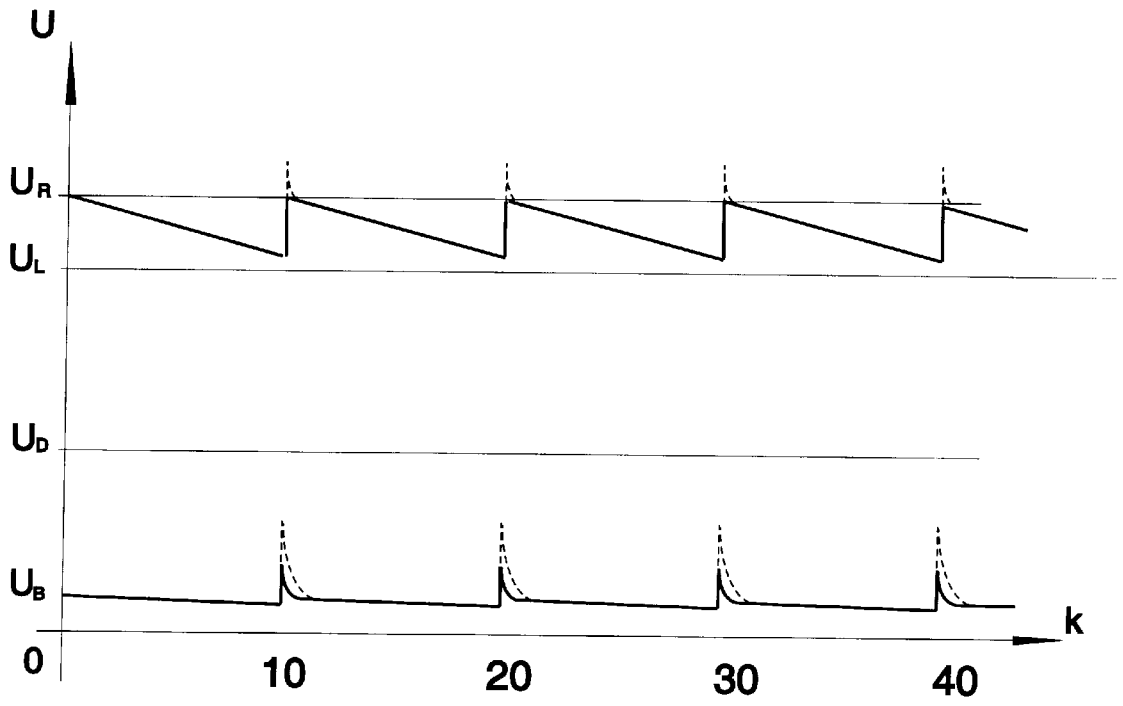
FIG. 13 illustrates a method of maintaining the potential level of a latent electrostatic image during the active discharge of the photoreceptor.

FIG. 13 illustrates a diagram of a method of maintaining a given level of the surface potential during the copying process under the active discharge of the applicable photoreceptor. In this specific example, periodical recharging after each 10 copies is considered. Here, $U_R$ is the initial value of the surface potential in an arbitrary point of the electrostatic image element; $U_L$ is the minimal (limit) value of the potential level providing a given optical density of the image element during its development; $U_D$ is the bias voltage supplied to a counter-electrode of the developer tool; $U_B$ is the background level of the potential relief (lower level of recording); k is the number of copies to be produced. Solid lines in the figure show the condition when recharging dose corresponds to the discharge value of the photoreceptor. In this case, the surface potential of the image elements (in the range $U_R$–$U_L$) reduces approximately by the same portions during the production of each copy, and the total reduction of the surface potential proceeds substantially in accordance with the linear dependence. Potential in the additionally charged blanked regions decays in accordance with the exponential dependence, i.e., more intensive, and does not noticeably affect the quality of the developed image, even at the maximal value of this potential. This is due to the fact that the condition $|U_D|>|U_B|$ is practically always satisfied. The value $U_D$ is conditionally shown as constant. If the charge dosage is excessive, i.e., exceeds the value of photoreceptor discharge (dashed lines), the excessive charges in the image regions as well as in the blanked regions will be held solely by the free compensating charges of the opposite polarity induced in the electrically conductive substrate, and will therefore exist during a small period of time. The interval ($U_R$–$U_L$) is selected in accordance with the condition of providing the stability of the optical density of the image elements in copies during their production, within the time interval between the recharging procedures.

The invented method of recharging the applicable photoreceptor, due to the time stability of the potential relief of the latent electrostatic image, enables to increase the durability of the duplication process, and consequently, to increase the number of copies produced from one recording cycle (one exposure). The part of the recording time in the total time period required for producing these number of copies is reduced, and therefore affects the throughput of the electrophotographic apparatus at a less extent. These conditions enable to increase the recording time and to use more inexpensive and technologically effective low-sensitive photosemiconductor layers in the photoreceptors.

The time of the natural process of the passive discharge of the photoreceptor laminated by a dielectric film depends on dark resistance of the photosemiconductor layer, and can significantly exceed the total time of multiple-copy production. Such an electrostatic "memory" of the photoreceptor with the dielectric coating allows for performing the formation of the latent electrostatic image at a low-speed recording mode without the recharging. As for the multiple-copy production during which active discharge of the photoreceptor takes place, this electrostatic memory enables its higher-speed mode with regular recharge of the photoreceptor for maintaining the surface potential value at a given level. Therefore, the isolation of technological speeds of the recording process ($V_R$) and the process of multiple-copy production ($V_T$) (e.g., $V_R<V_T$), becomes possible. The recording stage and the process of multiple-copy production may be timely separated. Hence, the recording time $t_R$ (in seconds) in the copying mode can be determined according to the following equation:

$$t_R = c\cdot\left(\frac{60}{P} - \frac{L}{V_T}\right)$$

wherein:

c is the number of copies produced from one recording;

P is the productivity of the electrophotographic apparatus (copies/min);

L is the length of the copy along the path of its motion (mm);

$V_T$ is the technological speed of the process of multiple-copy production (mm/sec).

The reduction of the speed of formation of the latent electrostatic image simplifies the exposure conditions and improves the quality of recording that significantly depends on the inertness and dynamic characteristics of the optical scanning system.

Thus, due to the new principle of recording of the latent electrostatic image onto an intermediate information carrier (applicable photoreceptor) having a dielectric coating, as well as to the technological and time isolation of the electrophotographic stages of the copying process, the advantages of the invented technique are as follows:

the high quality recording of the electrostatic image;

the ability to use an intermediate information carrier as an electrostatic matrix;

considerable increase in service-life of the photoreceptors used in the electrophotographic apparatus.

The application of the invented process for electrophotographic multiple-copy production allows for increasing the functional possibilities and the productivity of a copying apparatus aimed at producing a large number of copies. Moreover, the copying process according to the invention is more beneficial (as compared to the conventional processes), due to the decrease in the number of process stages during the multiple-copy production, which provides the decrease of cost price of the produced copies. Furthermore, exploitation conditions are facilitated, the construction is simplified, the reliability is increased, and, therefore, the service-life of the apparatus is also increased.

Those skilled in the art will readily appreciate that various modifications and changes may be applied to the preferred embodiments of the invention as hereinbefore exemplified without departing from its scope defined in and by the appended claims.

What is claimed is:

1. A method of electrophotographic copying of information utilizing the recording of an electrostatic image of the original information onto a recording photoreceptor, wherein said electrostatic image is in the form of a pattern that has spaced-apart charged regions of a certain polarity that correspond to image elements and are spaced by blanked uncharged regions, the method including at least one cycle comprising the steps:

(a) forming a latent electrostatic image of the original information which is to be copied on an intermediate information carrier by means of an interaction between said recording photoreceptor and said intermediate information carrier, wherein the intermediate information carrier is a photoreceptor having an electrically conductive substrate carrying a photosemiconductor layer with a dielectric coating made of a high-resistance material that possesses desired mechanical properties, the intermediate information carrier being such that it, whilst being charged, stores the charge configuration corresponding to the original information during a desired period of time required for producing a desired number of copies of the original information;

(b) developing said latent electrostatic image on the intermediate information carrier;

(c) transferring the developed image from the intermediate information carrier onto a final information carrier; and (d) fixing the transferred image on the final information carrier.

2. The method according to claim 1, wherein the dielectric coating is transparent to visible light.

3. The method according to claim 1, wherein the dielectric coating is opaque, said substrate being transparent to visible light and being metallized by a semitransparent layer located thereon, underneath the photosemiconductor layer.

4. The method according to claim 1, wherein the formation of the latent electrostatic image comprises:

uniformly charging the surface of the intermediate information carrier by charges of the opposite polarity with respect to the charges of the image elements on the recording photoreceptor, wherein said charging is carried out with simultaneous illumination of the photosemiconductor layer of the intermediate information carrier;

engaging the surfaces of the recording photoreceptor and the intermediate information carrier; and subsequently disengaging said surfaces; and illuminating the photosemiconductor layer of the disengaged intermediate information carrier.

5. The method according to claim 4, wherein the dielectric coating of the intermediate information carrier is opaque and said substrate is transparent to visible light and is metallized by a semitransparent layer located thereon underneath the photosemiconductor layer, said illuminating of the photosemiconductor layer of the disengaged intermediate information carrier being performed through the transparent substrate.

6. The method according to claim 4, wherein the dielectric coating of the intermediate information carrier is transparent to visible light, said illuminating of the photosemiconductor layer of the disengaged intermediate information carrier being performed through the dielectric coating.

7. The method according to claim 1, and also comprising the step of:

maintaining the latent electrostatic image in the form of a potential relief formed on the surface of the intermediate information carrier at a given level during the entire process of copying.

8. The method according to claim 7, wherein the maintaining of the potential level comprises the step of recharging the surface of the intermediate information carrier.

9. A method of electrophotographic copying of original information, the method comprising the steps of:

forming a latent electrostatic image on the surface of an intermediate information carrier, said latent electrostatic image being in the form of a potential relief of said surface, wherein said intermediate information carrier comprises an electrically conductive substrate carrying a photosemiconductor layer with a dielectric coating, and is such that it, whilst being charged, stores the charge configuration corresponding to the original information during a desired period of time required for producing a desired number of copies of said original information;

maintaining said potential relief at a given level during the entire process of copying;

developing said latent electrostatic image on the intermediate information carrier;

transferring the developed image from the intermediate information carrier onto a final information carrier; and fixing the transferred image on the final information carrier.

10. The method according to claim 9, wherein said maintaining of the potential level comprises the step of recharging the surface of the intermediate information carrier.

11. The method according to claim 10, wherein said recharging comprises regularly or episodically adding a dosage of charge, and episodically illuminating the photosemiconductor layer of the intermediate information carrier.

12. The method according to claim 10, wherein said recharging comprises the step of:

charging the surface of the intermediate information carrier in darkness by uniformly depositing thereon unipolar compensating charges of a given value, the polarity of the compensating charges corresponding to the polarity of the latent electrostatic image formed on the surface of the intermediate information carrier.

13. The method according to claim 12, wherein said given value of the compensating charges is defined by reduction of the surface potential.

14. The method according to claim 13, wherein said reduction of the surface potential is caused by dark discharge inside the photosemiconductor layer.

15. The method according to claim 14, wherein said recharging process also comprises subsequent illumination of the photosemiconductor layer of the intermediate information carrier.

16. The method according to claim 13, wherein said given value of the compensating charges is defined by reduction of the surface potential caused by external affects.

17. The method according to claim 11, wherein said recharging process is episodically repeated a required number of times.

18. An electrophotographic apparatus for producing a desired number of copies of original information, the apparatus comprising:

(i) a cylindrically shaped recording photoreceptor;

(ii) a recording system for electrostatic recording of an image of said original information onto the recording photoreceptor;

(iii) a cylindrically shaped rotatable intermediate information carrier in the form of a photoreceptor comprising an electrically conductive substrate carrying a photosemiconductor layer coated with a dielectric layer having high-resistance and high mechanical strength characteristics, the intermediate information carrier being such that it, whilst being charged, stores the charge configuration corresponding to the original information during a desired period of time required for producing said desired number of copies;

(iv) an imaging system for forming latent electrostatic image of the original information on the intermediate information carrier by means of an interaction between the recording photoreceptor and the intermediate information carrier;

(v) a developer tool for developing the latent electrostatic image on the intermediate information carrier;

(vi) a transfer means for transferring the developed image onto a final information carrier; and (vii) a fixating means for fixating the transferred image on the final information carrier.

19. The apparatus according to claim 18, wherein said dielectric layer is transparent to visible light.

20. The apparatus according to claim 18, wherein said dielectric layer is opaque, while the substrate is transparent to visible light and is mettalized by a semitransparent layer located thereon underneath the photosemiconductor layer.

21. The apparatus according to claim 18, wherein said recording system comprises a charging device for charging the surface of the recording photoreceptor, and an exposure tool.

22. The apparatus according to claim 18, wherein said image formation system comprises:

a charging device for charging the surface of the intermediate information carrier;

an illumination system for illuminating a photosemiconductor layer of the intermediate information carrier; and a drive for displacing the recording photoreceptor between its operative and inoperative position so as to provide engagement and disengagement between the surfaces of the recording photoreceptor and the intermediate information carrier.

* * * * *